US010935033B2

(12) United States Patent
Lin et al.

(10) Patent No.: US 10,935,033 B2
(45) Date of Patent: Mar. 2, 2021

(54) FAN FRAME MODULE AND FAN MODULE

(71) Applicant: DELTA ELECTRONICS, INC., Taoyuan (TW)

(72) Inventors: Hung-Wei Lin, Taoyuan (TW); Chih-Hui Wu, Taoyuan (TW); Ming-Kai Hsieh, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 219 days.

(21) Appl. No.: 15/916,832

(22) Filed: Mar. 9, 2018

(65) Prior Publication Data

US 2018/0195516 A1 Jul. 12, 2018

Related U.S. Application Data

(63) Continuation of application No. 14/872,456, filed on Oct. 1, 2015, now abandoned.

(60) Provisional application No. 62/079,843, filed on Nov. 14, 2014.

(30) Foreign Application Priority Data

Jun. 30, 2015 (CN) ..... 201510372655.6

(51) Int. Cl.
*F04D 25/06* (2006.01)

(52) U.S. Cl.
CPC ..... *F04D 25/0693* (2013.01); *F04D 25/0613* (2013.01)

(58) Field of Classification Search
CPC ..... F04D 25/0613; F04D 25/0693
See application file for complete search history.

(56) References Cited

U.S. PATENT DOCUMENTS

| | | | | |
|---|---|---|---|---|
| 4,160,576 | A | 7/1979 | Vettori | |
| 6,942,471 | B2 * | 9/2005 | Weisser | F04D 25/08 417/423.1 |
| 7,273,400 | B2 | 9/2007 | Horng | |
| 8,376,884 | B2 | 2/2013 | Spaggiari | |
| 9,163,637 | B2 * | 10/2015 | Hsieh | F04D 25/0613 |
| 10,408,216 | B2 * | 9/2019 | Takeshita | F04D 29/325 |
| 2007/0099459 | A1 * | 5/2007 | Otsuki | F04D 25/0613 439/144 |
| 2007/0280840 | A1 | 12/2007 | Sugiyama | |
| 2008/0153345 | A1 * | 6/2008 | Chen | F04D 25/0613 439/485 |

(Continued)

*Primary Examiner* — Justin D Seabe
(74) *Attorney, Agent, or Firm* — Muncy, Geissler, Olds & Lowe, P.C.

(57) ABSTRACT

A fan frame module comprises a frame and a wire-stopping structure. In the frame, an outer wall is divided into a first side section, a first mid section, a central section, a second mid section and a second side section in a first direction. The extension direction of the major axis of the central section is parallel to the central axis of the frame, and the first direction is perpendicular to the extension direction of the major axis of the central section. A wire groove is formed on the first mid section to accommodate a wire. A fastening portion is disposed on one side of the wire groove. A positioning portion is disposed on the other one side of the wire groove. The wire-stopping structure is held by the fastening portion and the positioning portion, and fixed to the outer wall.

10 Claims, 29 Drawing Sheets

(56) References Cited

U.S. PATENT DOCUMENTS

2014/0205430 A1 7/2014 Chang
2014/0308121 A1* 10/2014 Tang ..... F04D 29/644
415/220

* cited by examiner

FAN FRAME MODULE AND FAN MODULE

CROSS REFERENCE TO RELATED APPLICATIONS

This application is a continuation application of U.S. Ser. No. 14/872,456, filed Oct. 1, 2015, which claims priority to U.S. provisional patent application with Ser. No. 62/079,843 filed on Nov. 14, 2014 and under 35 U.S.C. § 119(a) on Patent Application No(s). 201510372655.6 filed in People's Republic of China on Jun. 30, 2015. This and all other extrinsic materials discussed herein are incorporated by reference in their entirety.

BACKGROUND

Technical Field

The invention relates to a fan frame module and a fan module.

Related Art

With the progress of technologies, the electronic devices become more and more efficient. However, if the heat generated by the electronic device is not properly dissipated, its performance becomes inferior and even the electronic device may burn out. Thus, the cooling device is a necessary equipment of the electronic device.

The fan module is a common active cooling device, and it usually includes a motor, an impeller, a circuit board and a frame. Generally, the motor is linked to the impeller and coupled to the circuit board, and the motor, the impeller and the circuit board are disposed in the frame. When starting the fan, the power supply provides electrical power by the electrical wire for the circuit board to drive the motor to operate and accordingly rotate the fan.

However, as to the fan 9 in FIG. 9, if these electrical wires connected to the circuit board are not arranged properly and disordered in the space utilized by the fan module, dusts is likely to be adhered to the electrical wires and causes that the temperature of the electrical wires raises. Thus, the performance of the fan is impacted. Besides, if the fan module is installed in a small space of an apparatus, wires may interfere with the apparatus so possibly it is stuck or breaks. As a result, the fan module could not be successfully installed and operated.

SUMMARY

A fan frame module according to the invention comprises a frame and a wire-stopping structure. The frame comprises an outer wall, a wire groove, at least one fastening portion and at least one positioning portion. The outer wall is sequentially divided into a first side section, a first mid section, a central section, a second mid section and a second side section in a first direction. The extension direction of the major axis of the central section is parallel to the central axis of the frame, and the first direction is perpendicular to the extension direction of the major axis of the central section. The wire groove is formed on the first mid section to accommodate at least one wire. The fastening portion is disposed on one side of the wire groove. The positioning portion is disposed on the other one side of the wire groove. The wire-stopping structure is held by the fastening portion and the positioning portion, and fixed to the outer wall.

In one embodiment, the wire-stopping structure has a first combination portion, and the first combination portion and the fastening portion are corresponding concave-convex structures.

In one embodiment, the wire-stopping structure has a second combination portion, and the second combination portion and the positioning portion are corresponding concave-convex structures.

In one embodiment, the wire-stopping structure pivots on a pivot at the fastening portion or the positioning portion.

In one embodiment, the frame further comprises at least one wire-guiding structure, and the wire-guiding structure leads the wire into the wire groove or leads the wire out of the wire groove.

In one embodiment, the fastening portion restricts the wire-stopping structure.

A fan module according to the invention comprises a frame, a wire-stopping structure and an impeller, disposed in the frame. The frame comprises an outer wall, a wire groove, at least one fastening portion and at least one positioning portion. The outer wall is sequentially divided into a first side section, a first mid section, a central section, a second mid section and a second side section in a first direction. The extension direction of the major axis of the central section is parallel to the central axis of the frame, and the first direction is perpendicular to the extension direction of the major axis of the central section. The wire groove is formed on the first mid section to accommodate at least one wire. The fastening portion is disposed on one side of the wire groove. The positioning portion is disposed on the other one side of the wire groove. The wire-stopping structure is held by the fastening portion and the positioning portion, and fixed to the outer wall. The impeller is disposed in the frame.

In one embodiment, the wire-stopping structure has a first combination portion, and the first combination portion and the fastening portion are corresponding concave-convex structures.

In one embodiment, the wire-stopping structure has a second combination portion, and the second combination portion and the positioning portion are corresponding concave-convex structures.

In one embodiment, the frame further comprise at least one wire-guiding structure, and the wire-guiding structure leads the wire into the wire groove or leads the wire out of the wire groove.

As mentioned above, as to the fan frame module and the fan module, because the wire-stopping structure covers the wire groove of the frame, the wire in the wire groove would not protrude from the outer wall. Thus, the wire would not interfere with external elements or wear, and it is easier to install the fan module. In some embodiments, the wire-stopping structure may further cover and shield the outlet hole of the frame so as to avoid the air leak occurring in the outlet hole of the conventional fan and improve characteristics of the air pressure and air volume.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1A:
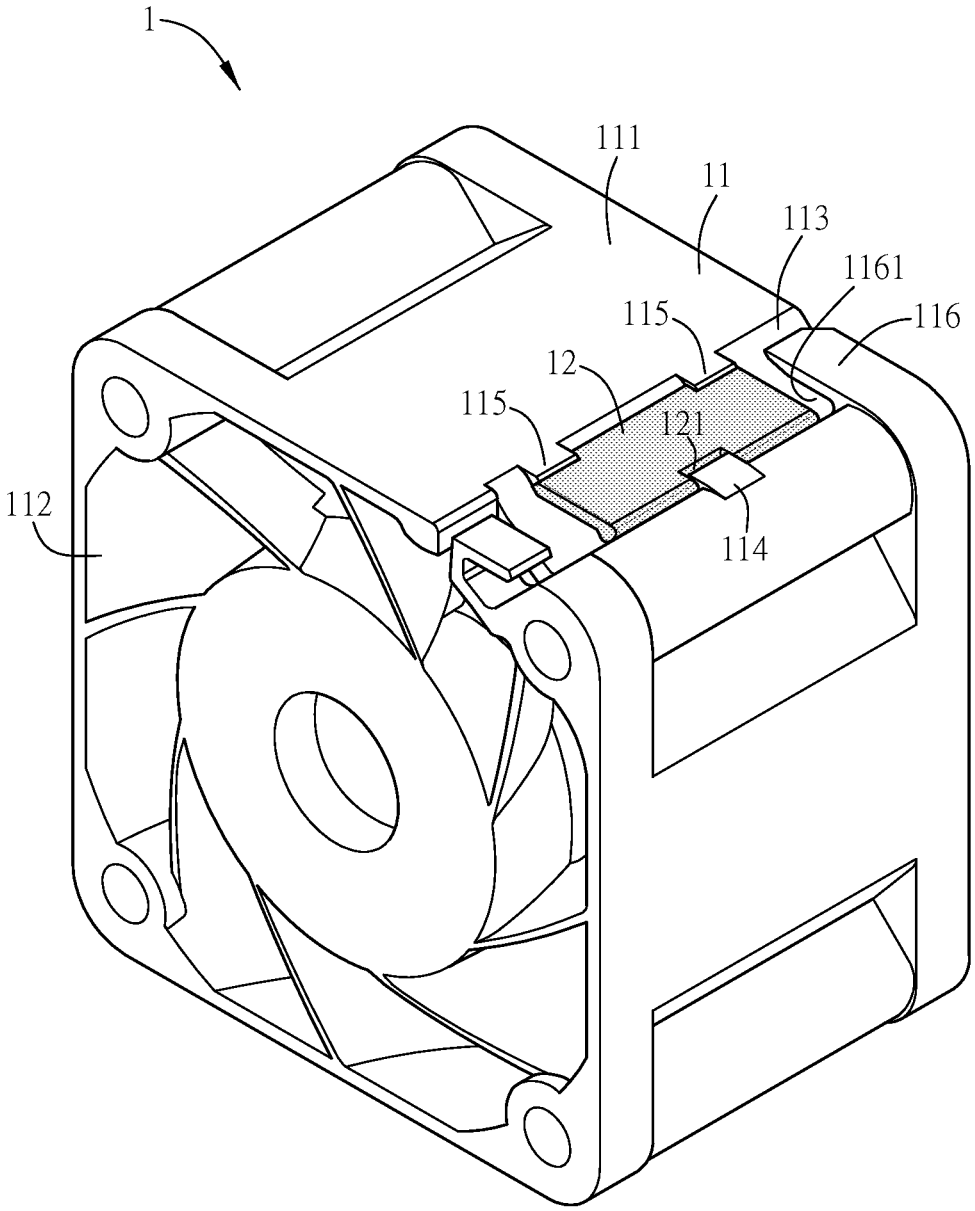
FIG. 1A is perspective schematic diagram showing a fan frame module according to the first embodiment of the invention.
Figure 1B:
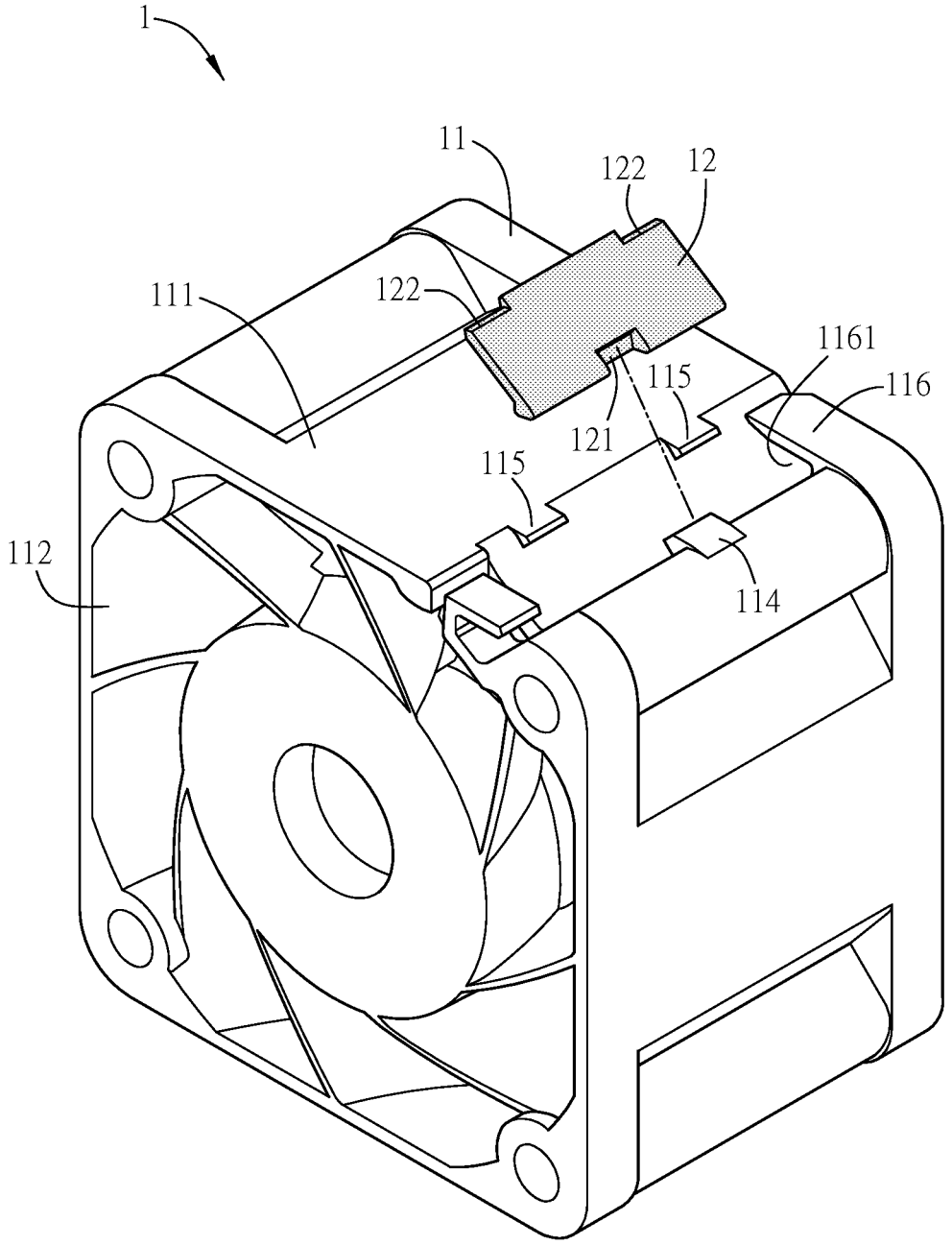
FIG. 1B is an exploded view of the fan frame module in FIG. 1A.
Figure 1C:
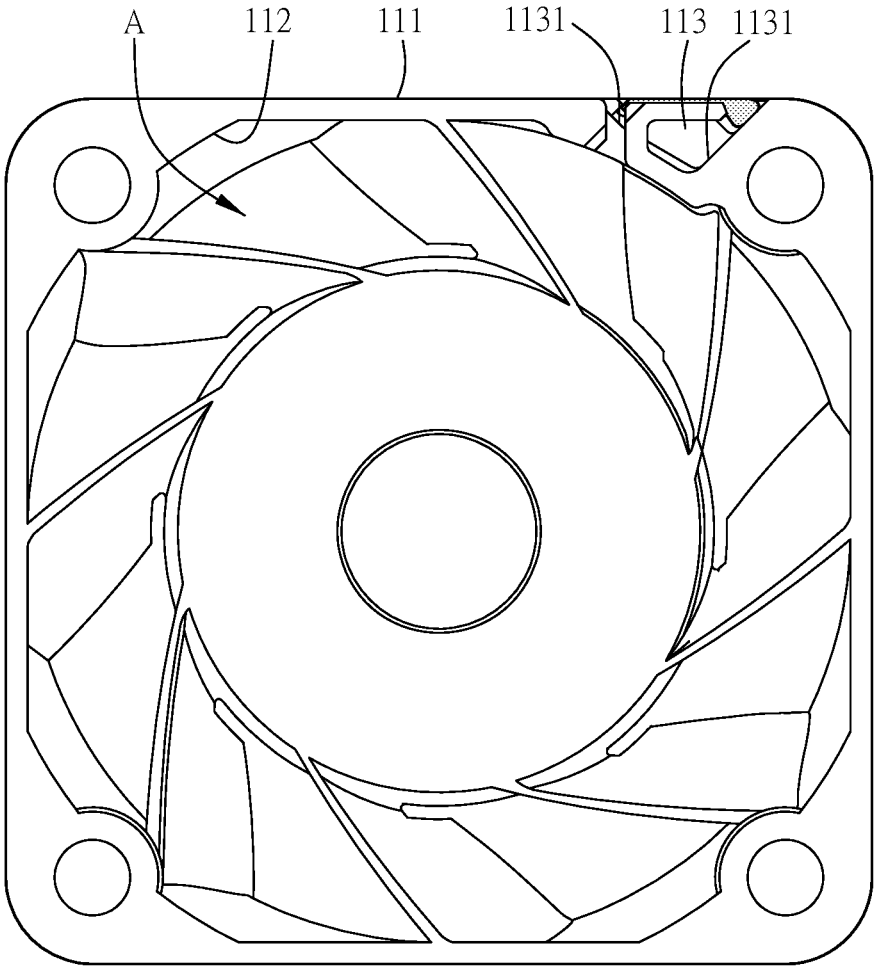
FIG. 1C is a lateral view of the fan frame module in FIG. 1A at axial viewing angle.

FIG. 1A is perspective schematic diagram showing a fan frame module according to the first embodiment of the invention, FIG. 1B is an exploded view of the fan frame module in FIG. 1A, and FIG. 1C is a lateral view of the fan frame module in FIG. 1A at axial viewing angle. Referring to FIG. 1A, FIG. 1B and FIG. 1C, the fan frame module 1 includes a frame 11 and a wire-stopping structure 12. The frame 11 includes an outer wall 111 and an inner wall 112. For example, in the frame 11, the outer wall 111 is roughly like a square ring, the inner wall 112 is roughly like a circular ring, and the frame 11 includes four corners. The inner wall 112 forms an accommodation space A to accommodate the fan, the motor or the circuit board or other elements so as to form a fan module. For the sake of clarity, the fan, the motor or the circuit board or other elements mentioned above are not illustrated.

Figure 1D:
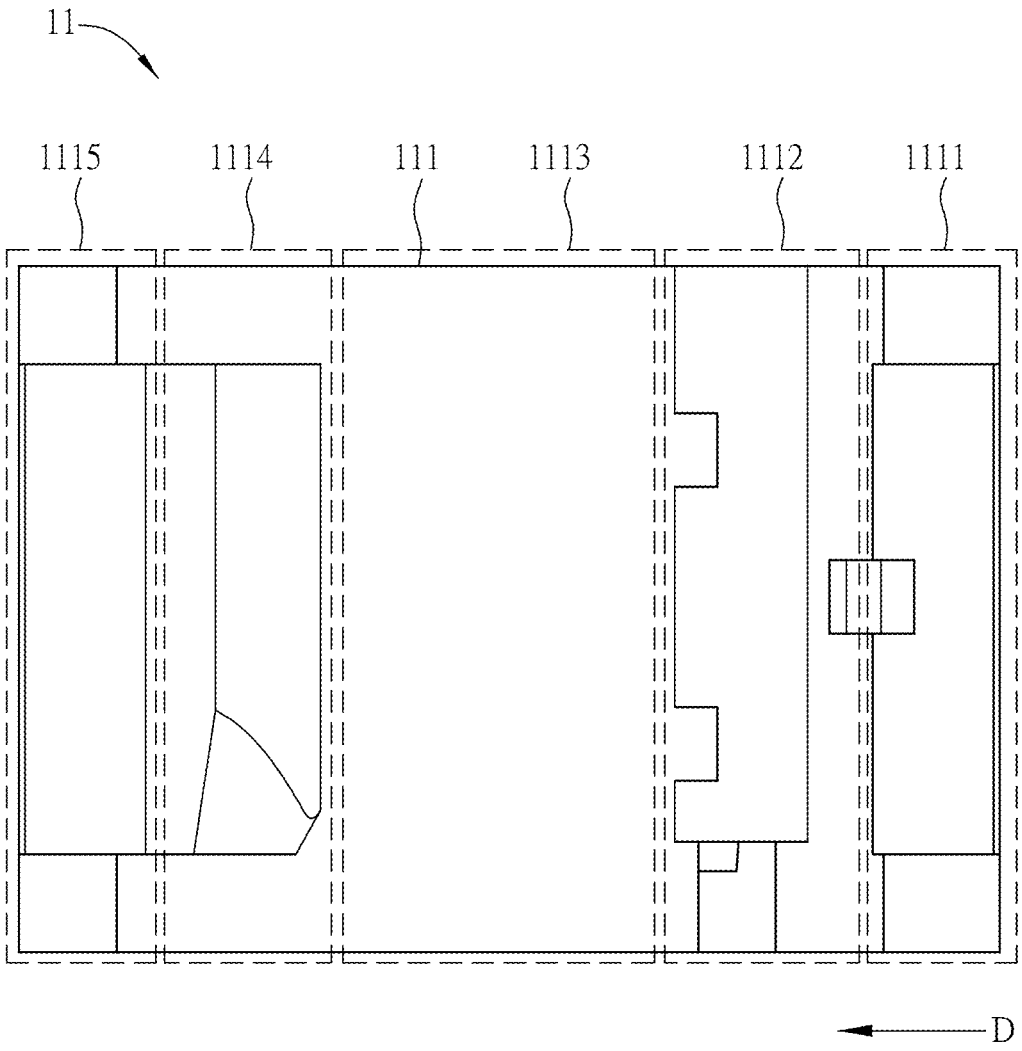
FIG. 1D is a lateral view of the fan frame module in FIG. 1A at radial viewing angle.

FIG. 1D is a lateral view of the fan frame module in FIG. 1A at radial viewing angle. Referring to FIG. 1D, the outer wall 111 is sequentially divided into a first side section 1111, a first mid section 1112, a central section 1113, a second mid section 1114 and a second side section 1115 in a first direction D. The extension direction of the major axis of the central section 1113 is parallel to the central axis of the frame 11, and the first direction D is perpendicular to the extension direction of the major axis of the central section 1113.

The frame 11 further includes a wire groove 113, at least one fastening portion 114 and at least one positioning portion 115. The wire groove 113 is formed on the first mid section 1112 to accommodate at least one wire which may be electrically connected to the circuit board mentioned above and the power supply. The wire groove 113 may be an arc groove face, or formed with two inclined planes, or it may be formed with two opposite lateral surfaces and a bottom surface. However, the recessed shape of the wire groove 113 is not limited. In the embodiment in FIG. 1C, the wire groove 113 has two lateral surfaces 1131 disposed oppositely, and each lateral surface 1131 and the outer wall 111 have an included obtuse angle.

The fastening portion 114 is disposed on one side of the wire groove 113 in the first direction D, and the positioning portion 115 is disposed on the other side of the wire groove 113 in the first direction D. In the embodiment, the fastening portion 114 and the positioning portion 115 are respectively located at different lateral surfaces 1131, and respectively extend from the outer wall 111 to each other. In the embodiment, there are two positioning portions 115 for example. There is an acute included angle between the fastening portion 114 and the lateral surface 1131, and there is another acute included angle between the positioning portion 115 and the other lateral surface 1131, too.

In the embodiment, the wire-stopping structure 12 is roughly like a rectangle board which corresponds to the fastening portion 114 and the positioning portion 115, so the wire-stopping structure 12 is held and fixed by the fastening portion 114 and the positioning portion 115 on the outer wall 111 to firmly cover the wire groove 113. Moreover, the wire-stopping structure 12 is detachably connected to the fastening portion 114 and the positioning portion 115 interferes with the wire-stopping structure 12, so the wire-stopping structure 12 is located in the wire groove 113 and not exposed from the outer wall 111. Therefore, the wire-stopping structure 12 could be sandwiched between the fastening portion 114 and the lateral surface 1131 to connect to the fastening portion 114. Similarly, the other side of the wire-stopping structure 12 could also be sandwiched between the positioning portion 115 and the other lateral surface 1131, so the wire-stopping structure 12 can firmly cover the wire groove 113 and it as well as the frame 11 would not be separated. Moreover, the periphery of the wire-stopping structure 12 may have fillets or chamfers for assembly of the wire-stopping structure 12 and the frame 11.

The wire-stopping structure 12 has a first combination portion 121 which and the fastening portion 114 are corresponding concave-convex structures. In the embodiment, the fastening portion 114 is a protruding block, the first combination portion 121 is correspondingly an indentation, and the protruding block (the fastening portion 114) engages with the indentation (the first combination portion 121). Besides, in the embodiment, the frame 11 includes two positioning portions 115 which are like protruding blocks. Similarly, the wire-stopping structure 12 at the other side opposite to the first combination portion 121 has two second combination portions 122 corresponding to these positioning portions 115, and the second combination portions 122 and the positioning portions 115 are corresponding concave-convex structures. Namely, the second combination portion 122 is correspondingly an indentation, so these positioning portions 115 can correspondingly engage with these second combination portions 122.

Figure 1E:
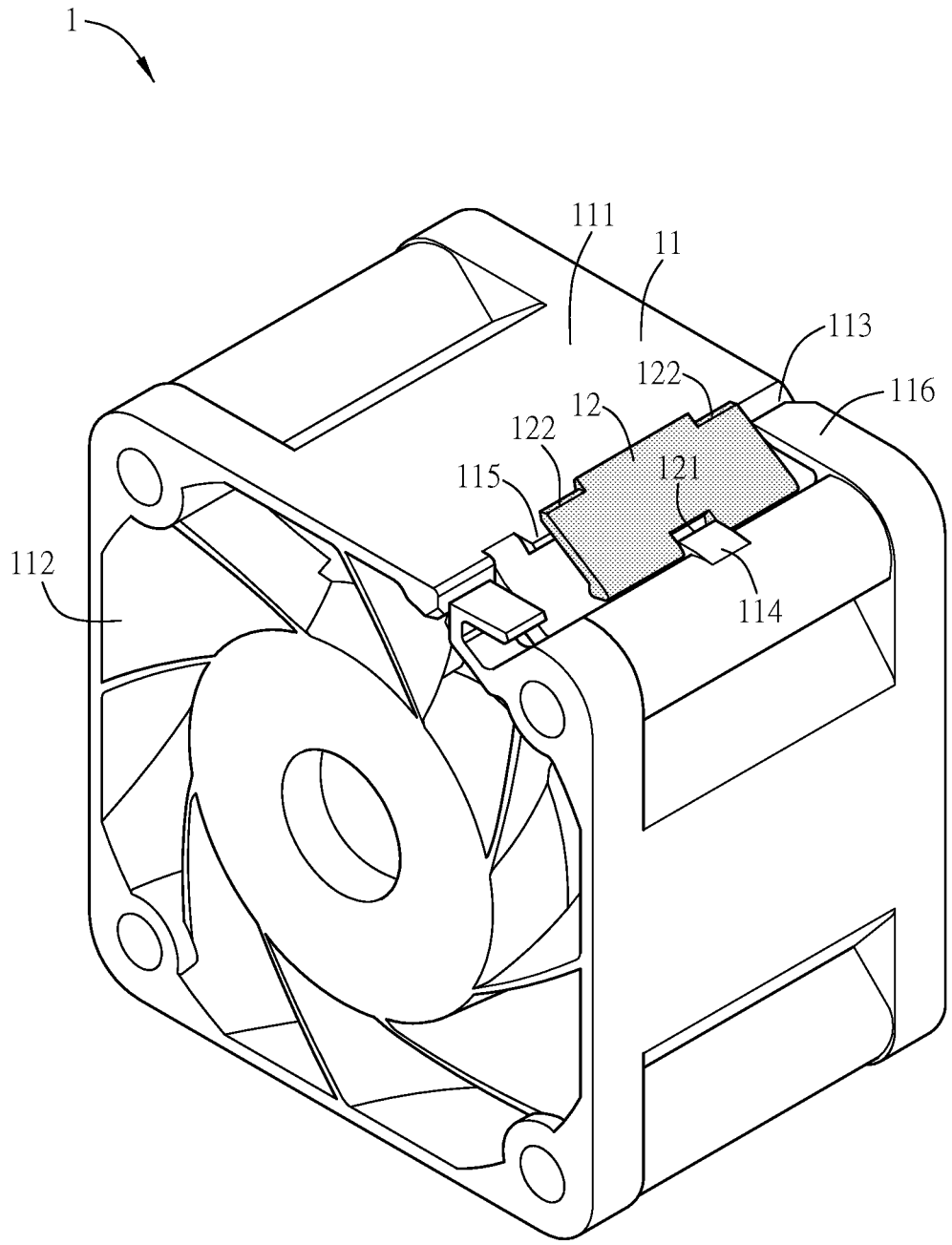
FIG. 1E is a schematic diagram showing the assembly process of the fan frame module in FIG. 1A.
Figure 1F:
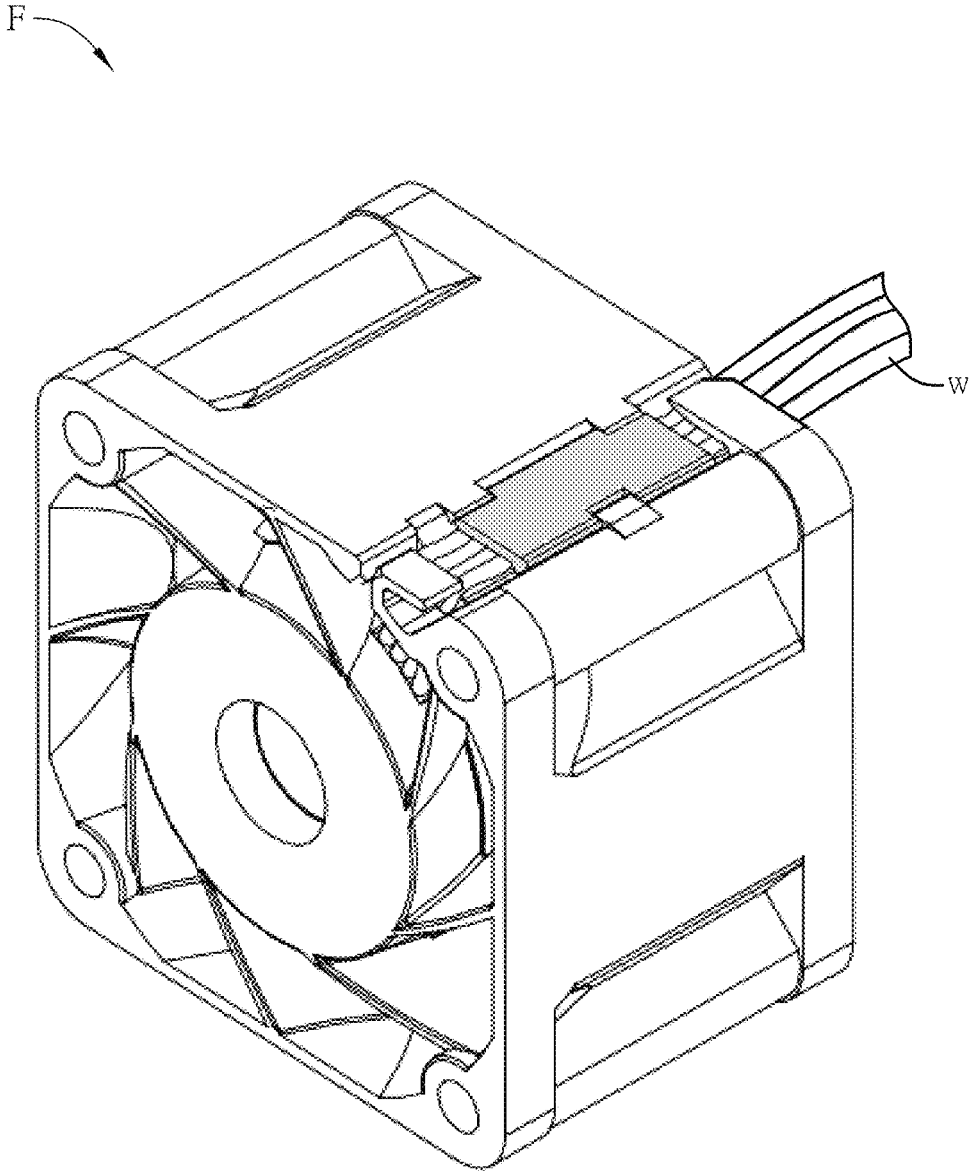
FIG. 1F is a schematic diagram showing the arranged wires of the fan frame module in FIG. 1A.

Referring to FIG. 1E, it is a schematic diagram showing the assembly process of the fan frame module in FIG. 1A. When assembling, the second combination portion 122 of the wire-stopping structure 12 may correspondingly abut the fastening portion 114 first. The abutted point acts as the pivot to rotate the wire-stopping structure 12 toward the wire groove 113. Then, the wire-stopping structure 12 is pushed in underneath the positioning portion 115. At the moment, the wire-stopping structure 12 is fixed by the fastening portion 114 and the positioning portion 115 and covers the wire groove 113. Therefore, as to the fan F shown in FIG. 1F, the wire w in the wire groove 113 would not protrude from the outer wall 111 so as to ensure that the wire w would not interfere with external elements or wear. Thus, it is easier to install the fan module.

Besides, in some embodiments, two opposite blind holes may be disposed on the fastening portion 114, and the line connecting the blind holes is parallel to the axial of the fan for example. Two bumps corresponding to the blind holes are disposed on the wire-stopping structure 12. Here, the wire-stopping structure 12 and the fastening portion 114 may be assembled by the bumps and the blind holes, so the assembled part of the wire-stopping structure 12 is like axial rotation to form a pivot structure. The disposition or location of the blind holes or the bumps may be varied, the above description is for example.

Besides, the frame 11 may further include a wire-guiding structure 116 which leads the wire into the wire groove 113 or leads the wire out of the wire groove 113. In the embodiment, the wire-guiding structure 116 is disposed at one end of the wire groove 113. For example, it is a structure from the bottom of the wire groove 113 along the lateral surface 1131 to the top opening of the wire groove 113, and it is also bent to extend in parallel with the outer wall 111. Here, the wire-guiding structure 116 forms a holding space 1161 communicating with the wire groove 113, so the wire can be held in the holding space 1161 and accordingly fixed. It is beneficial to adjust and fix the outlet direction of the wire.

Figure 1G:
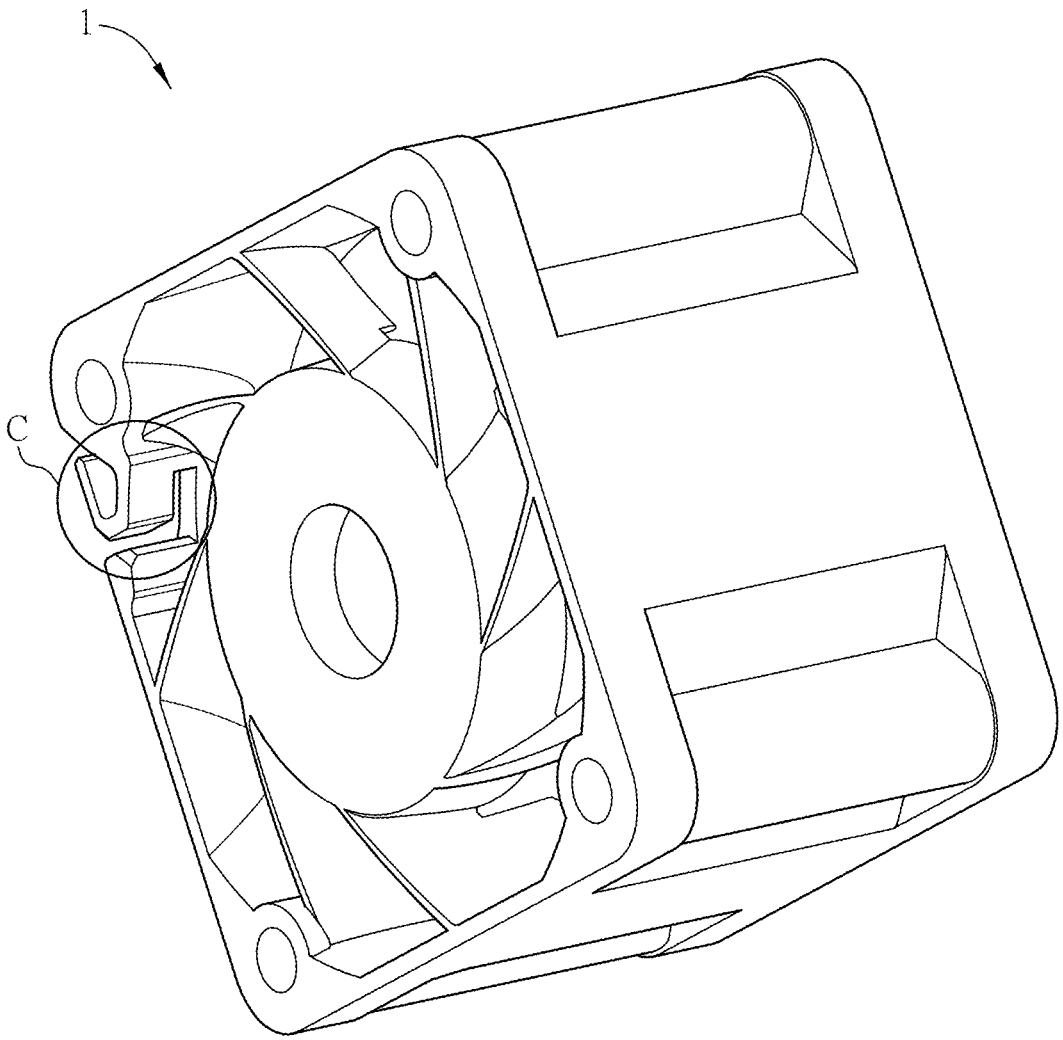
FIG. 1G is a perspective diagram showing the frame in FIG. 1A at another viewing angle.
Figure 1H:
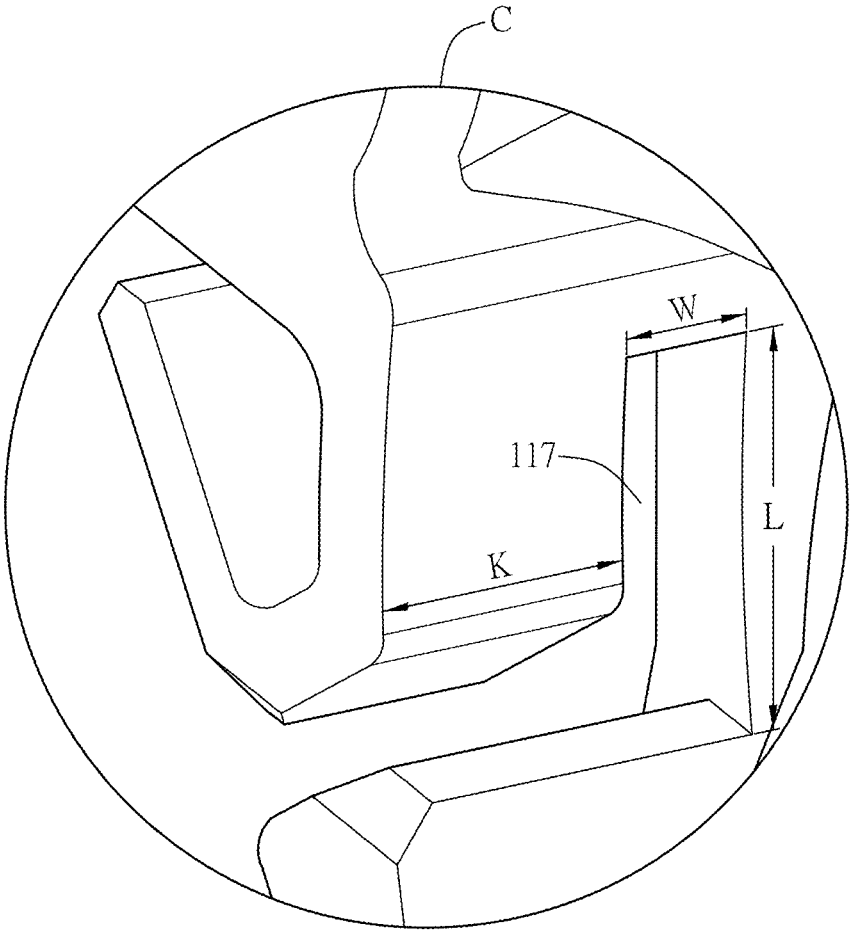
FIG. 1H is an enlarged diagram of the range C in FIG. 1G.

Moreover, referring to FIG. 1G and FIG. 1H, FIG. 1G is a perspective diagram showing the frame in FIG. 1A at another viewing angle, and FIG. 1H is an enlarged diagram of the range C in FIG. 1G. In the embodiment, the frame 11 may further include an outlet hole 117 which communicates with the wire groove 113 and the accommodation space A. Thus, the wire passes through the outlet hole 117 from the accommodation space A to the wire groove 113. In other words, the outlet hole 117 is the outlet hole of the wire. Besides, the outlet hole 117 may be a rectangle hole for example, its width W satisfies $d<W<2d$ and its length L satisfies $d \times n+X$, d is the diameter of a single wire, n is the wire quantity, and X is arranged wire margin. Moreover, the end faces of the outlet hole 117 and the wire groove 113 may have a distance K, or the outlet hole is formed on the end face of the wire groove 113, and it is not limited thereto.

Figure 2A:
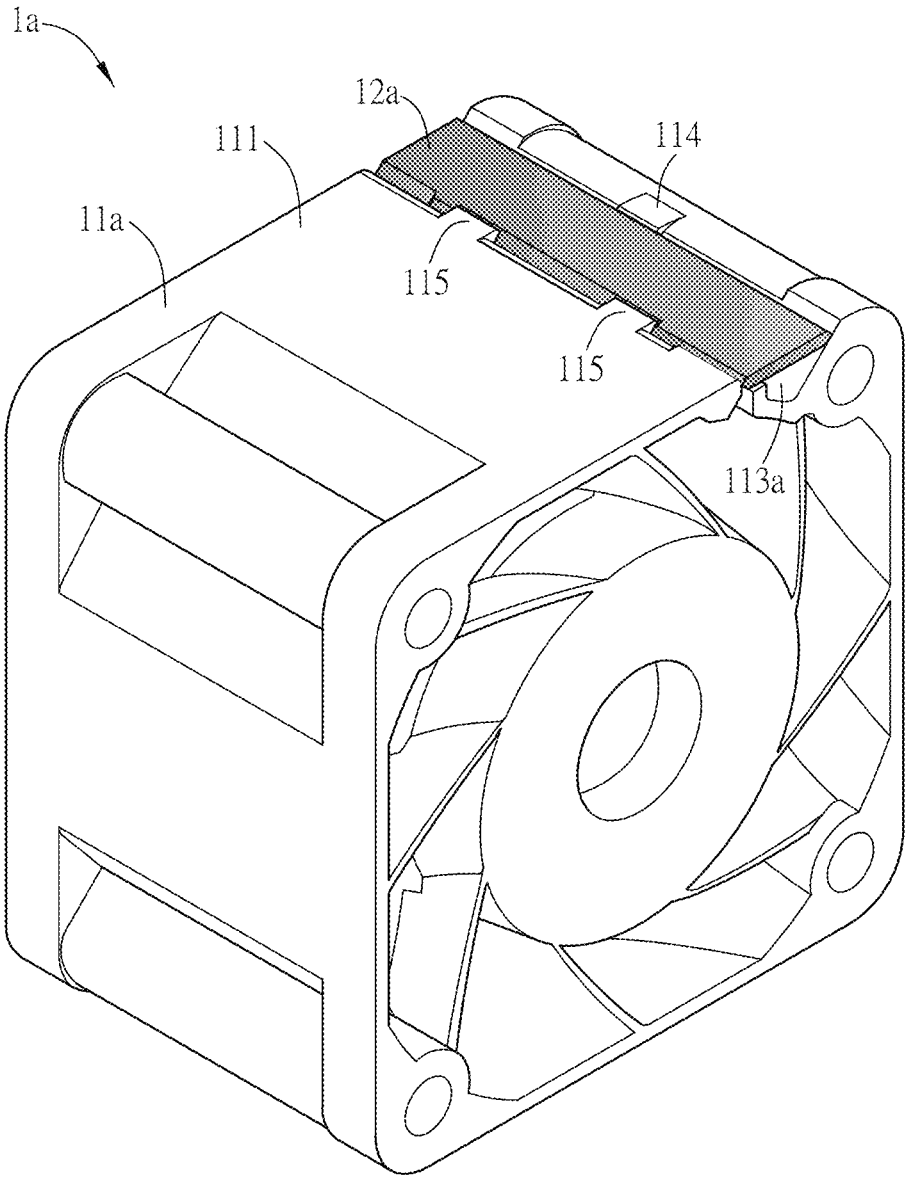
FIG. 2A is a perspective schematic diagram showing a fan frame module according to the second embodiment of the invention.
Figure 2B:
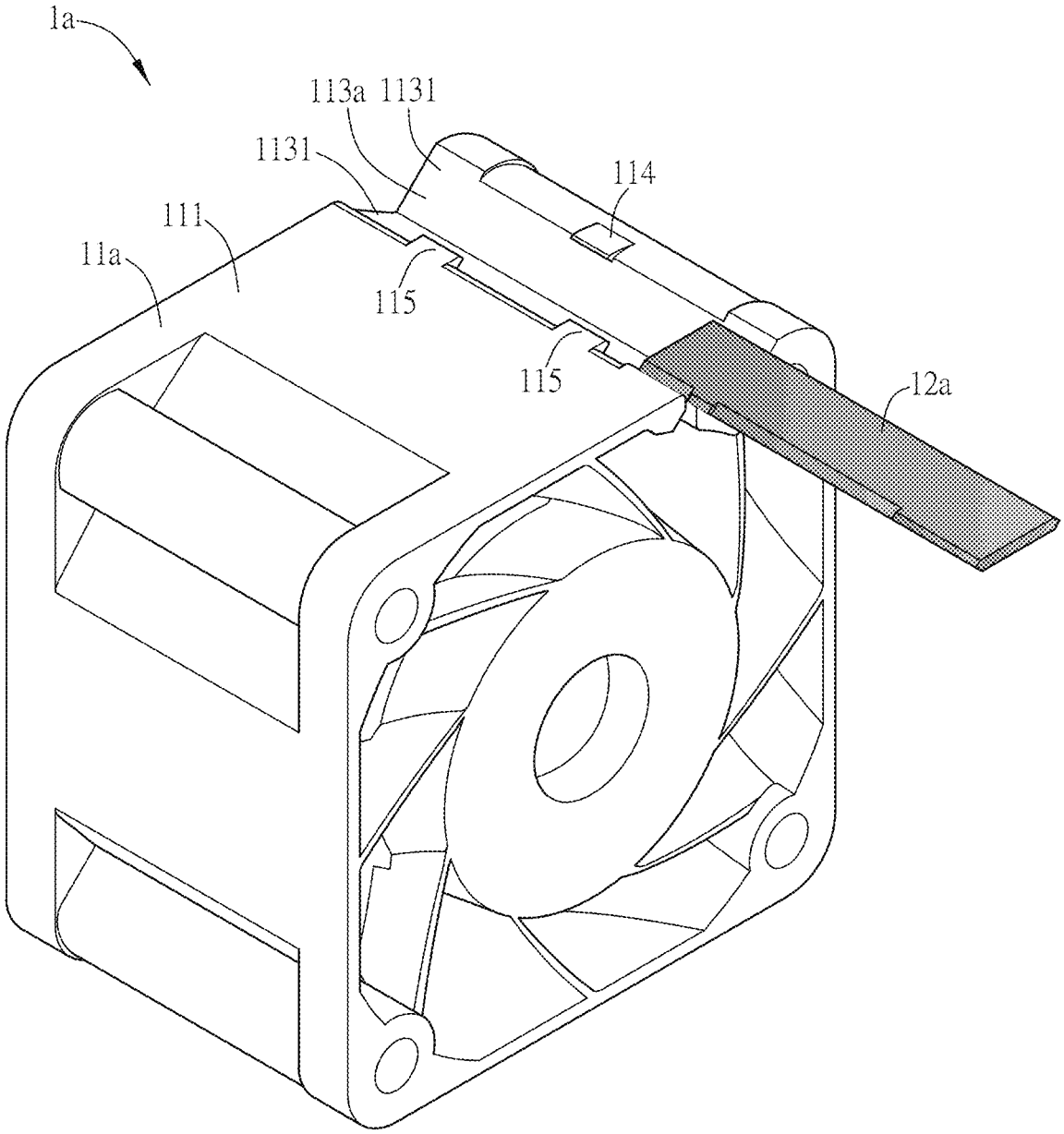
FIG. 2B is an exploded view of the fan frame module in FIG. 2A.
Figure 2C:
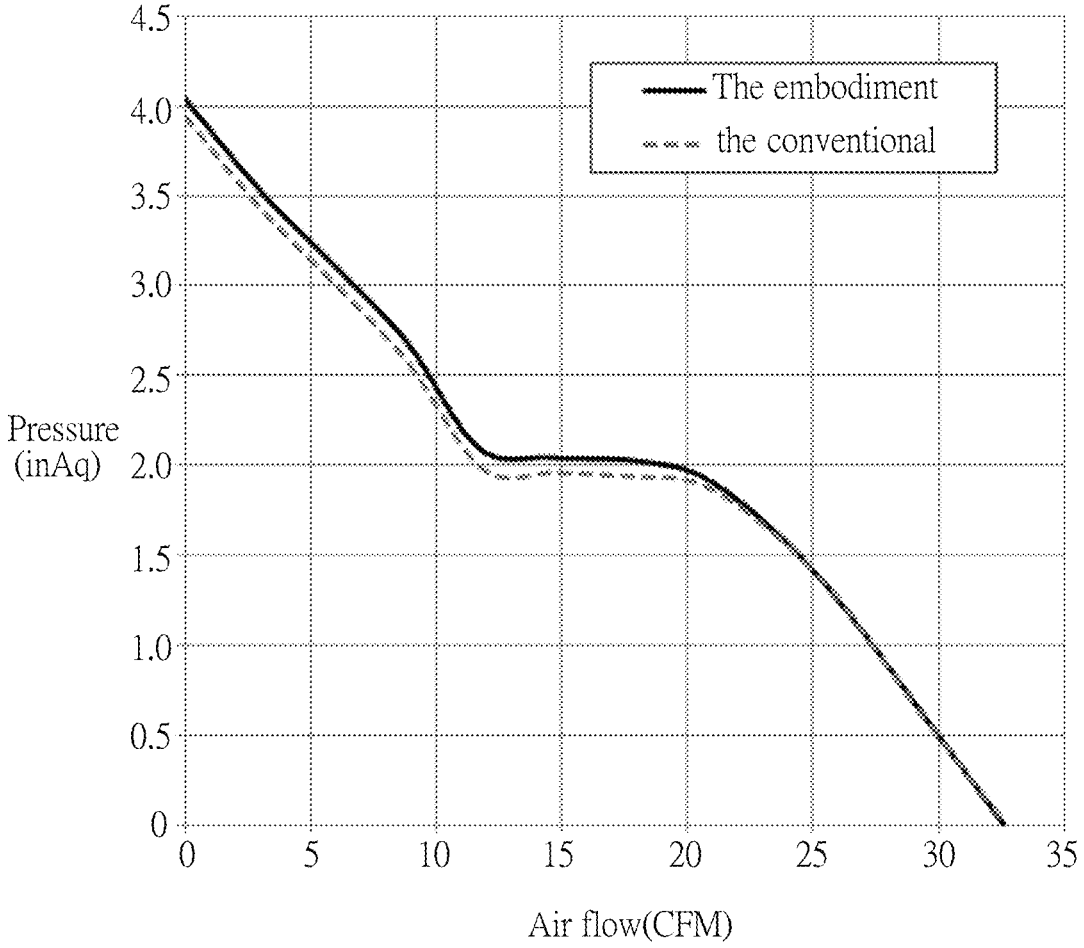
FIG. 2C is a diagram showing that the characteristics of the air pressure and air volume are enhanced due to the wire-stopping structure preventing the outlet hole from air leak.

FIG. 2A is a perspective schematic diagram showing a fan frame module according to the second embodiment of the invention, and FIG. 2B is an exploded view of the fan frame module in FIG. 2A. Referring to FIG. 2A and FIG. 2B, in the embodiment, the frame 11*a* of the fan frame module 1*a* does not have the wire-guiding structure 116 in the previous embodiment. The length of the wire-stopping structure 12*a* is equal to the length of the wire groove 113*a*. Therefore, in addition to completely covering the wire groove 113*a*, the wire-stopping structure 12*a* may further cover and shield the outlet hole 117 (as shown in FIG. 1H) so as to avoid the air leak occurring in the outlet hole of the conventional fan and improve characteristics of the air pressure and air volume as shown in FIG. 2C. As to assembly, the wire-stopping structure 12*a* may be install on the frame 11*a* by fastening like the first embodiment, or it may be placed in from one end of the wire groove 113*a* and then slid up to a desire location.

Figure 3A:
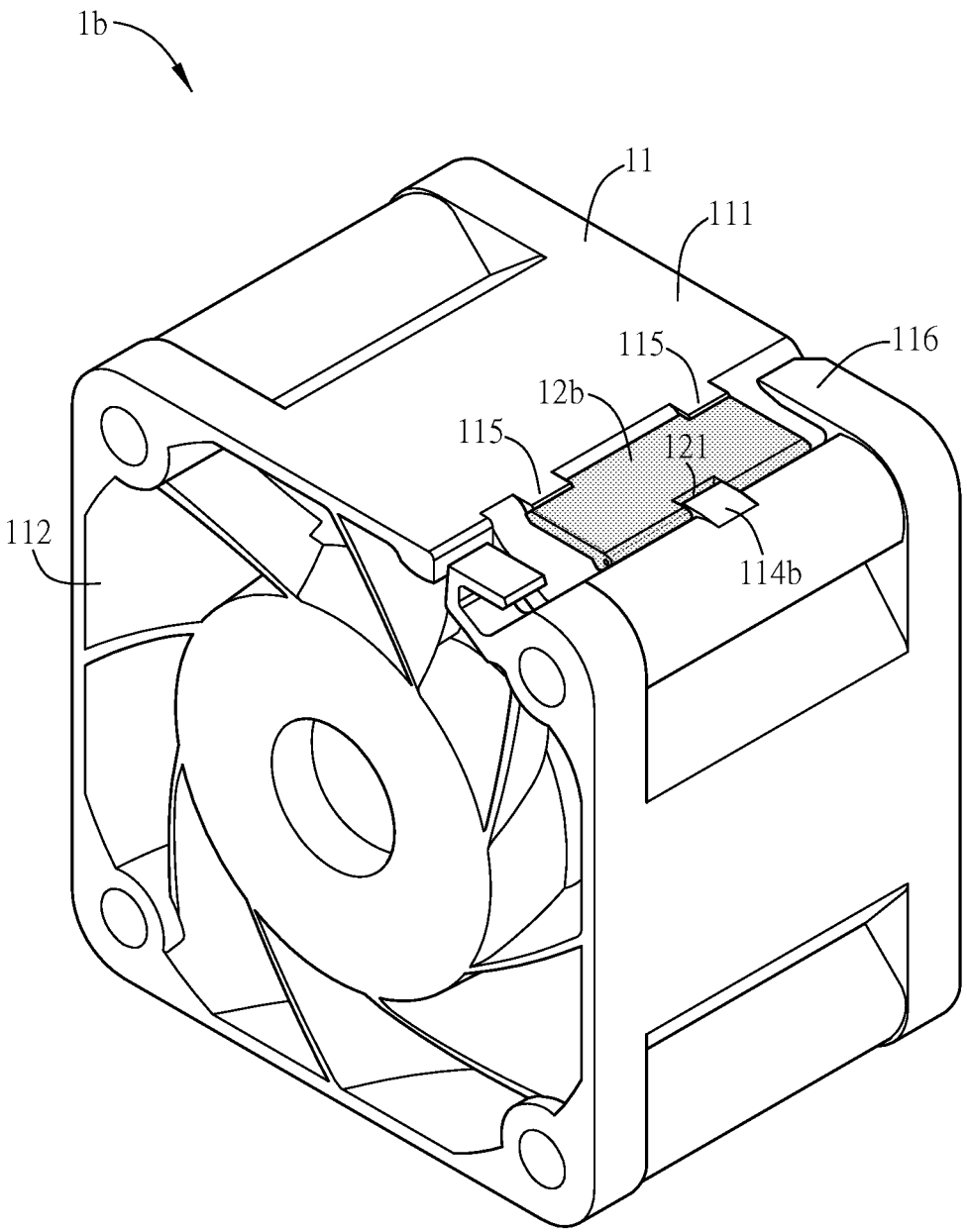
FIG. 3A is a perspective schematic diagram showing a fan frame module according to the third embodiment of the invention.
Figure 3B:
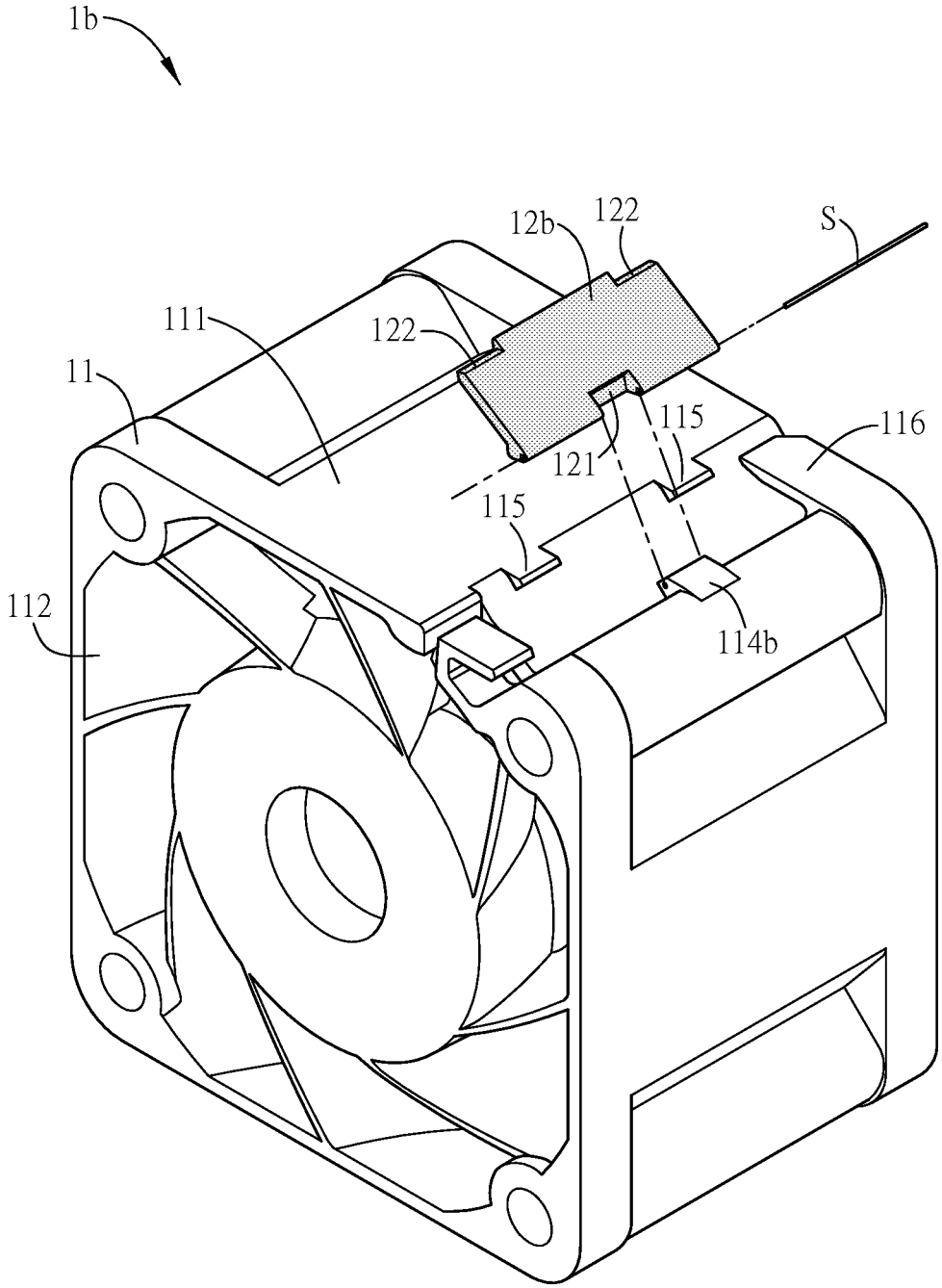
FIG. 3B is an exploded view of the fan frame module in FIG. 3A.

FIG. 3A is a perspective schematic diagram showing a fan frame module according to the third embodiment of the invention, and FIG. 3B is an exploded view of the fan frame module in FIG. 3A. Referring to FIG. 3A, this embodiment is similar to the first embodiment mentioned above. But the difference is that in this embodiment, the wire-stopping structure 12*b* of the fan frame module 1*b* pivots on a pivot S at the fastening portion 114*b*. In details, corresponding through holes are formed respectively on the wire-stopping structure 12*b* and the fastening portion 114*b*, so the pivot S can pass through these through holes and the wire-stopping structure 12*b* and the fastening portion 114*b* are pivoted on it. As a result, the wire-stopping structure 12*b* may be opened or closed with respect to the pivot S as the axis, and it is more difficult to separate the wire-stopping structure 12*b* and the frame 11. Alternatively, the wire-stopping structure 12*b* may pivot on the pivot S at the positioning portion 115, and it is not limited thereto.

Figure 4A:
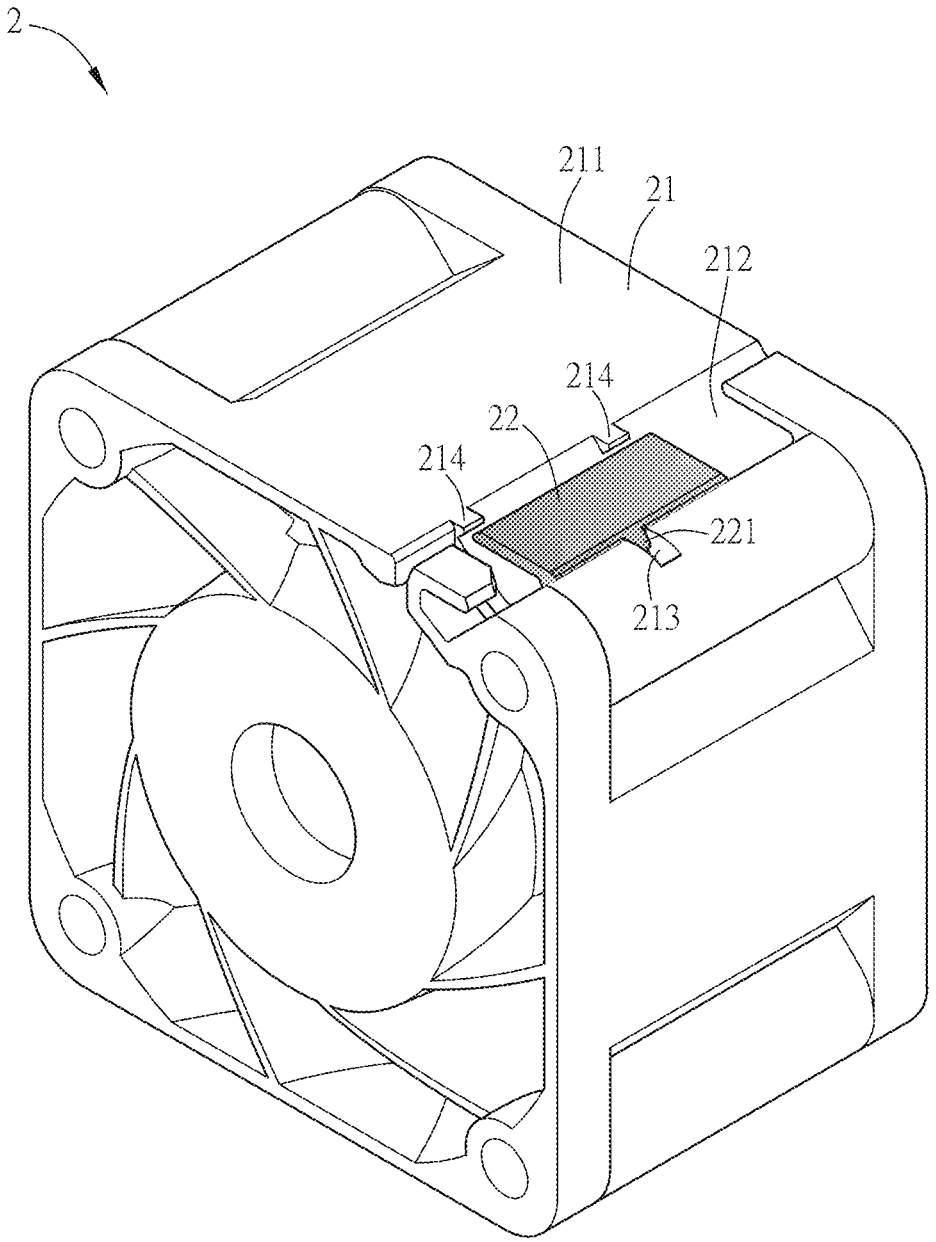
FIG. 4A is a perspective schematic diagram showing a fan frame module according to the fourth embodiment of the invention.
Figure 4B:
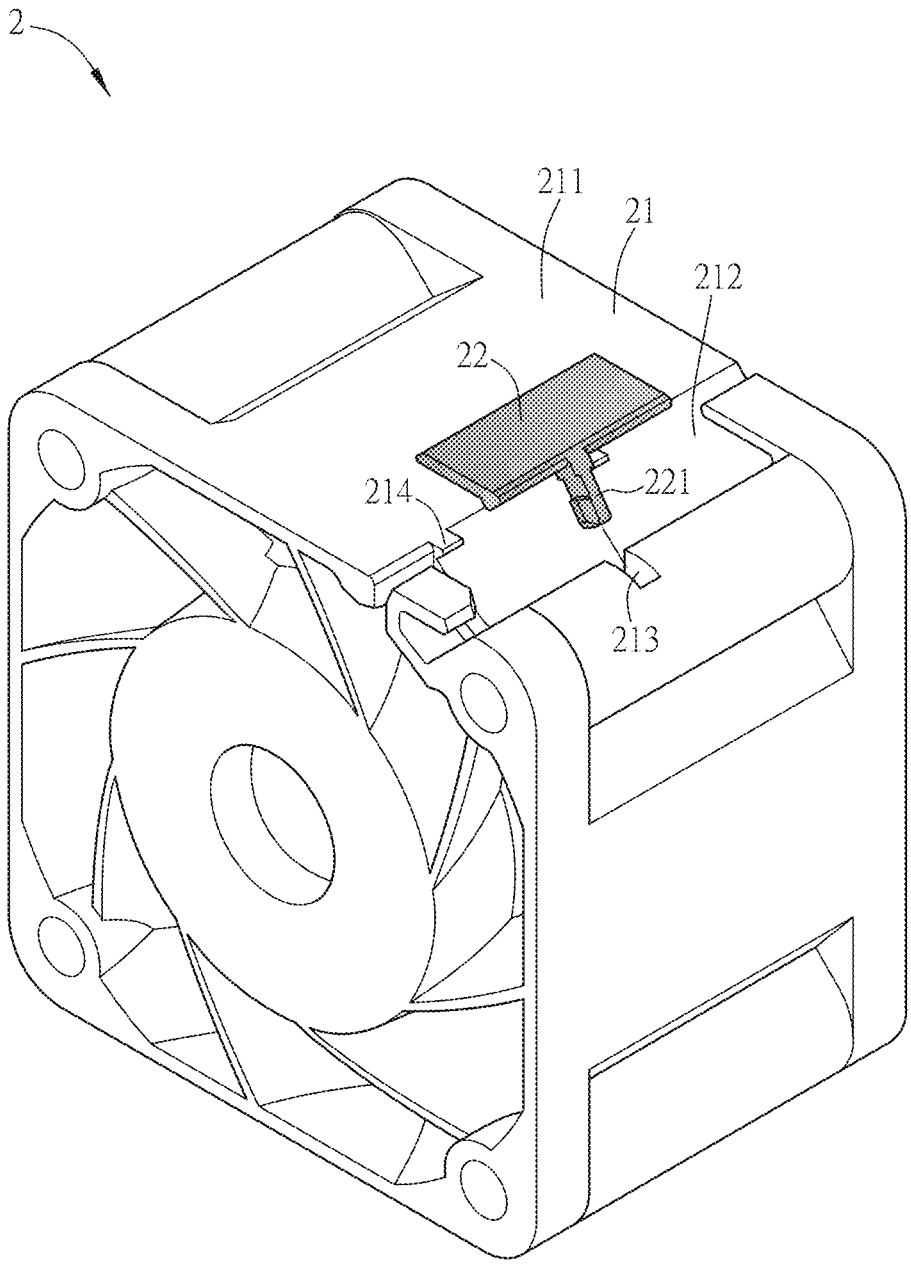
FIG. 4B is an exploded view of the fan frame module in FIG. 4A.
Figure 4C:
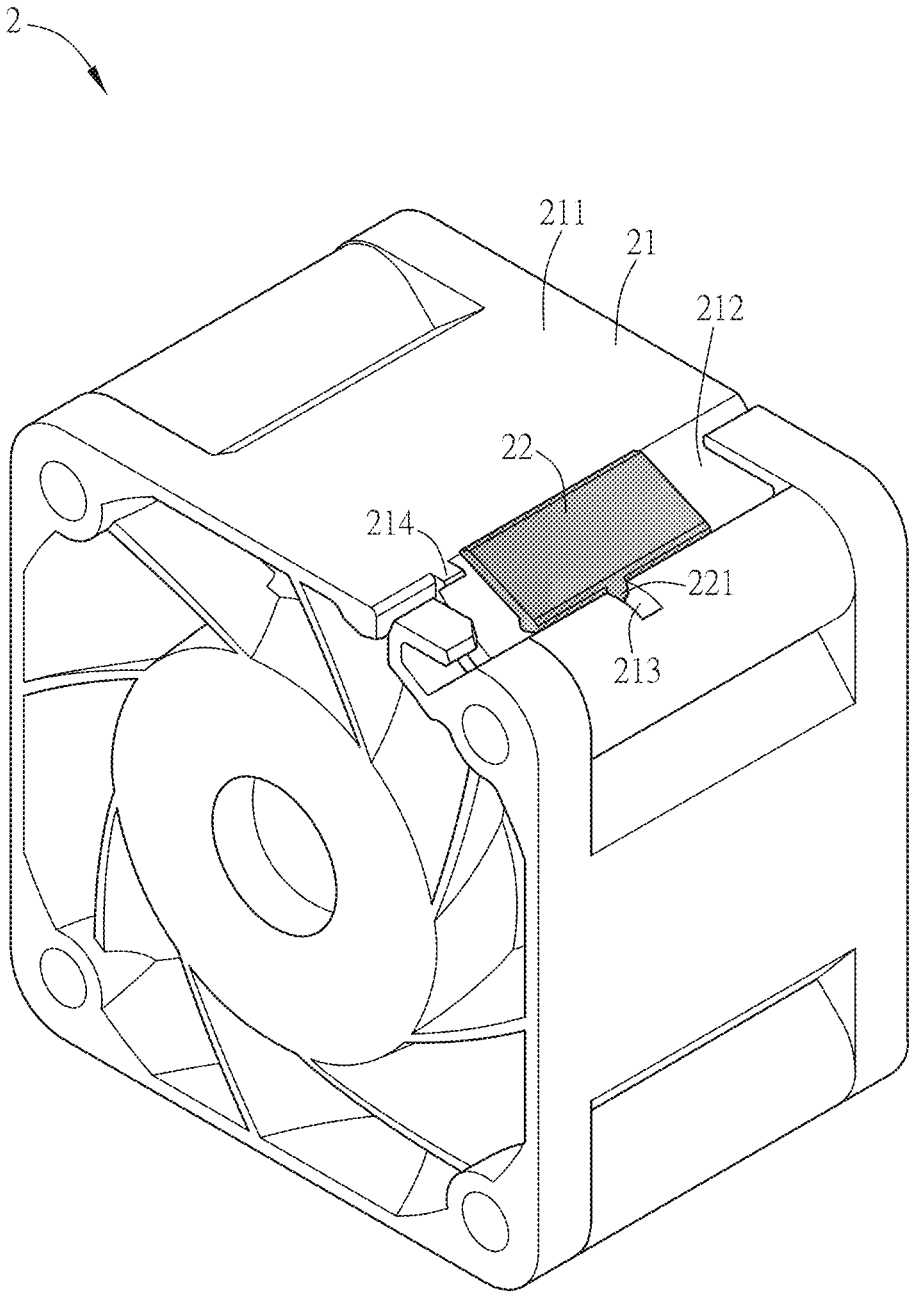
FIG. 4C is a schematic diagram showing the assembly process of the fan frame module in FIG. 4A.

FIG. 4A is a perspective schematic diagram showing a fan frame module according to the fourth embodiment of the invention, FIG. 4B is an exploded view of the fan frame module in FIG. 4A, and FIG. 4C is a schematic diagram showing the assembly process of the fan frame module in FIG. 4A. Referring to FIG. 4A, FIG. 4B and FIG. 4C, the fan frame module 2 includes the frame 21 and the wire-stopping structure 22. The frame 21 includes the outer wall 211, the wire groove 212, the fastening portion 213 and the positioning portion 214. The difference between this embodiment and the previous embodiments is that the fastening portion 213 is an indentation, the first combination portion 221 of the wire-stopping structure 22 is a protruding block, and the first combination portion 221 engages with the indentation (the fastening portion 213). Furthermore, the wire-stopping structure 22 is roughly like a rectangle board, and it has the first combination portion 221 which extends from its longitudinal side corresponding to the fastening portion 213. The extension direction of the first combination portion 221 is not coplanar with the board. As a result, the wire-stopping structure 22 engages with the indentation (the fastening portion 213) by the first combination portion 221 to fix above the wire groove 212 and to cover the wire groove 212.

When assembling the wire-stopping structure 22, referring to FIG. 4C, the first combination portion 221 of the wire-stopping structure 22 may correspondingly abut the fastening portion 213 first. The abutted point acts as the pivot to rotate the wire-stopping structure 22 toward the wire groove 212. Then, the wire-stopping structure 22 is pushed in underneath the positioning portion 214. At the moment, the wire-stopping structure 22 is fixed by the fastening portion 213 and the positioning portion 214 and covers the wire groove 212. As a result, the wire in the wire groove 212 would not protrude from the outer wall 211 so as to ensure that the wire w in the wire groove 113 would not protrude from the outer wall 111 so as to ensure that the wire would not interfere with external elements or wear. Thus, it is easier to install the fan module.

Figure 4D:
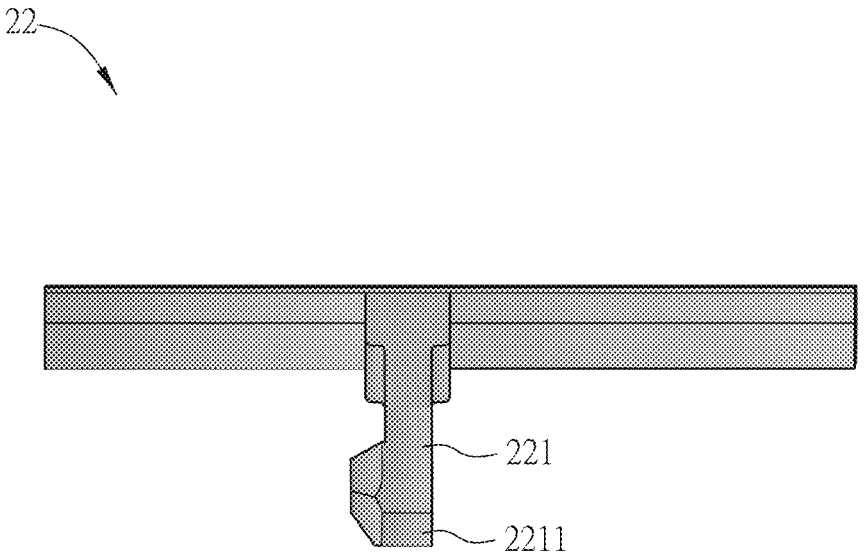
FIG. 4D is a lateral view showing the wire-stopping structure 22 of the fan frame module in FIG. 4A.

Moreover, referring to FIG. 4D, it is a lateral view showing the wire-stopping structure 22 of the fan frame module in FIG. 4A. The first combination portion 221 may have a bend 2211 at its end to form a hook-like structure. The indentation (the fastening portion 213) may have a notch. When the first combination portion 221 engages with the indentation (the fastening portion 213), the hook-like structure may pass through the notch and hooks a portion of the frame at the notch. Therefore, the wire-stopping structure 22 can further firmly cover the wire groove 212 and it as well as the frame 21 would not be separated. Besides, the hook-like structure may be formed by the protruding block disposed near the end of the first combination portion 221, and it is not limited thereto. Alternatively, the hook-like structure of the first combination portion 221 is optional, the fixing may be achieved by merely simple concave-convex engagement or tight fit.

Figure 5A:
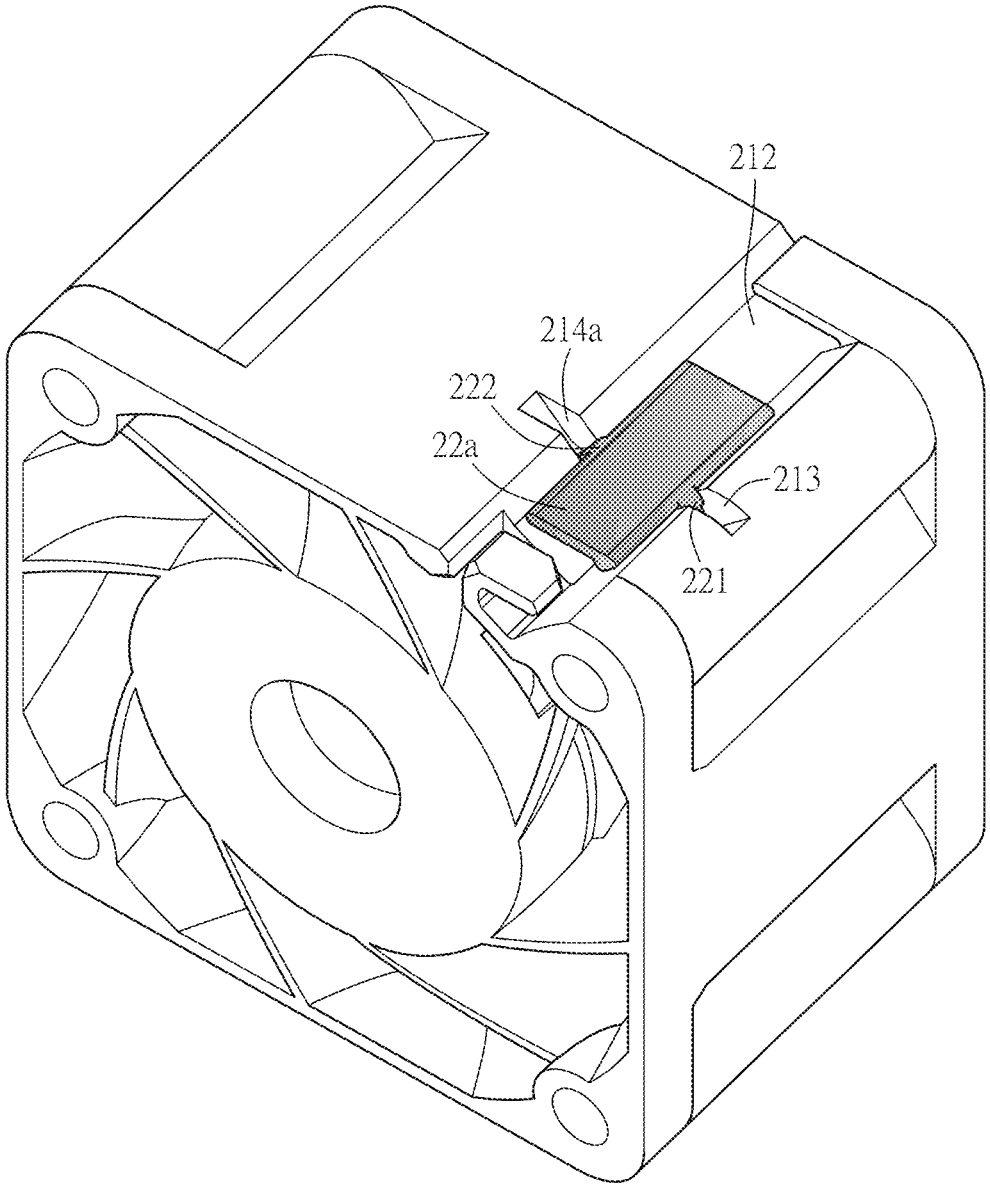
FIG. 5A is a perspective schematic diagram showing a fan frame module according to the fifth embodiment of the invention.
Figure 5B:
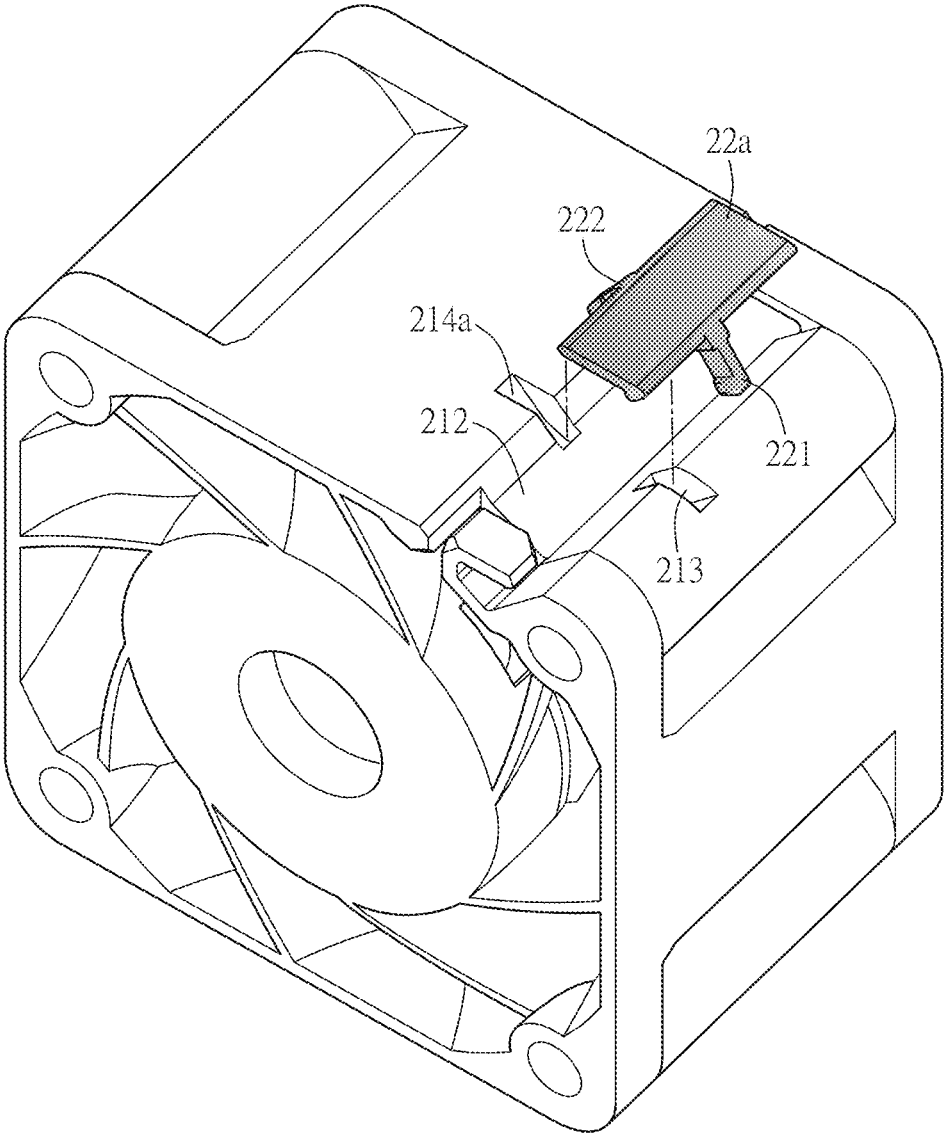
FIG. 5B is an exploded view of the fan frame module in FIG. 5A.
Figure 5C:
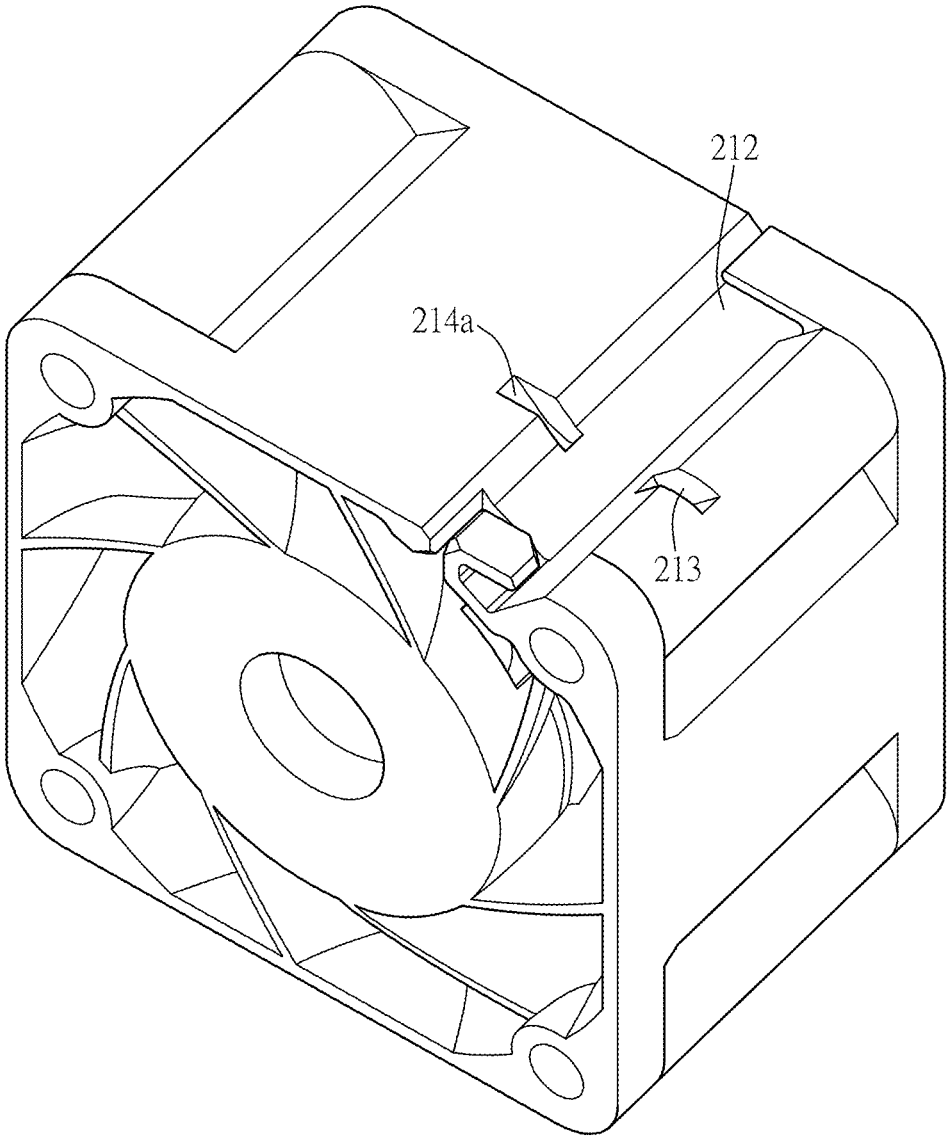
FIG. 5C is a schematic diagram showing the frame of the fan frame module in FIG. 5A.

FIG. 5A is a perspective schematic diagram showing a fan frame module according to the fifth embodiment of the invention, FIG. 5B is an exploded view of the fan frame module in FIG. 5A, and FIG. 5C is a schematic diagram showing the frame of the fan frame module in FIG. 5A. Referring to FIG. 5A, FIG. 5B and FIG. 5C, this embodiment is similar to the previous third embodiment. The difference is that in the embodiment, the positioning portion 214*a* is another indentation, the second combination portion 222 of the wire-stopping structure 22*a* is a protruding block. These protruding blocks (the first combination portion 221 and the second combination portion 222) respectively engage with these indentations (the fastening portion 213 and the positioning portion 214*a*), so the wire-stopping structure 22*a* can firmly cover the wire groove 212 and it as well as the frame 21 would not be separated.

Figure 6A:
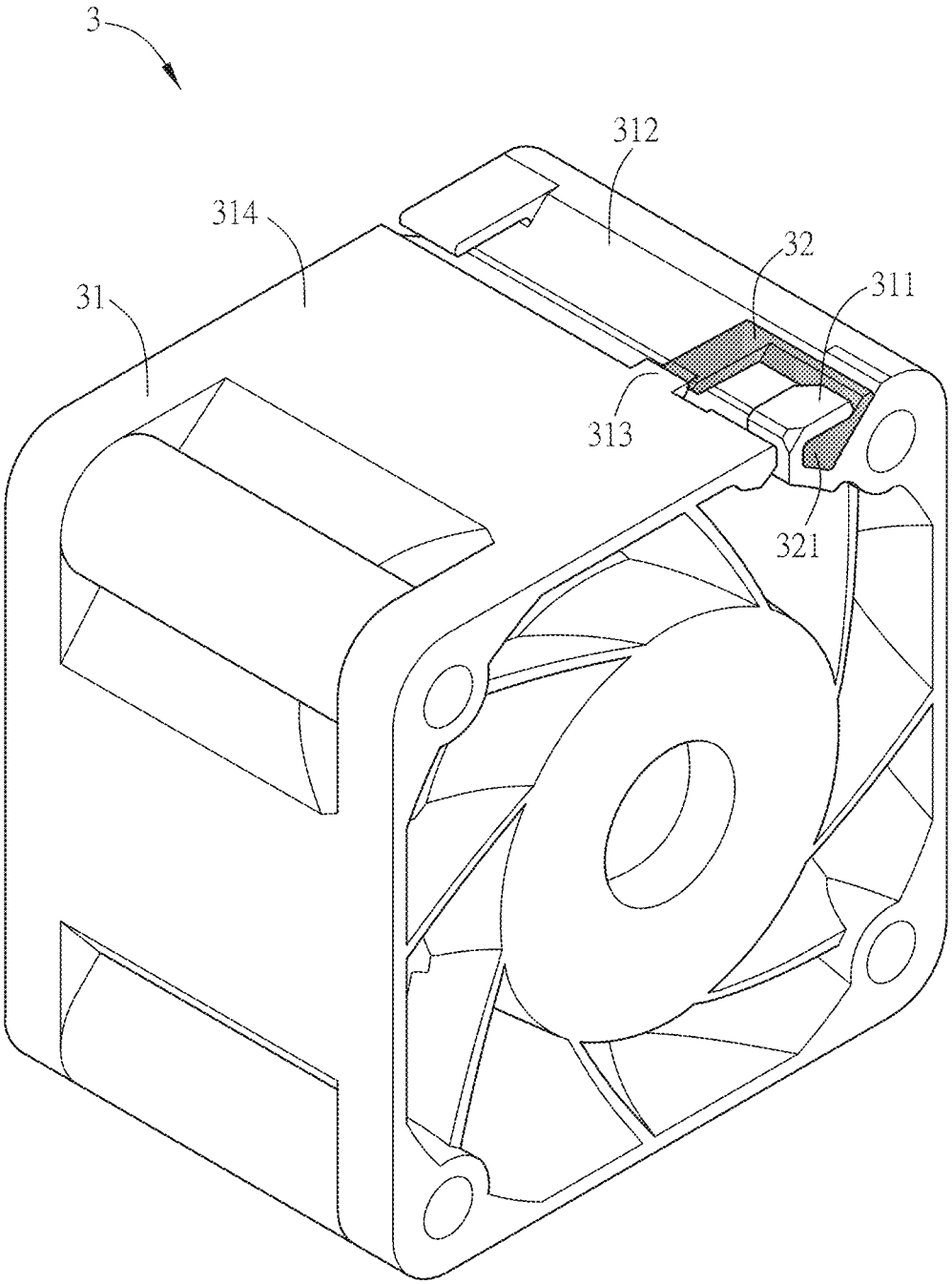
FIG. 6A is a perspective schematic diagram showing a fan frame module according to the sixth embodiment of the invention.
Figure 6B:
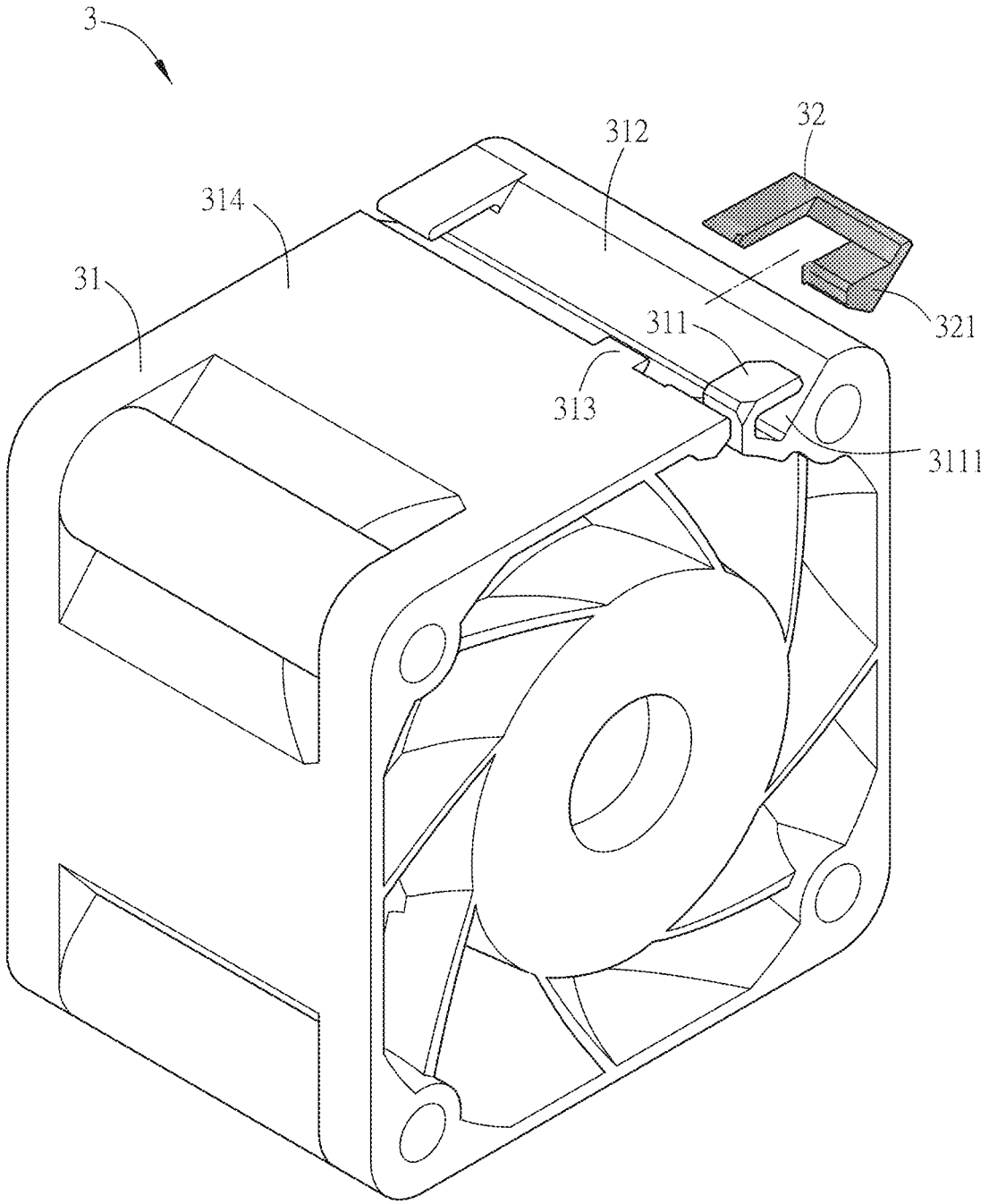
FIG. 6B is an exploded view of the fan frame module in FIG. 6A.

FIG. 6A is a perspective schematic diagram showing a fan frame module according to the sixth embodiment of the invention, and FIG. 6B is an exploded view of the fan frame module in FIG. 6A. Referring to FIG. 6A and FIG. 6B, the fan frame module 3 includes the frame 31 and the wire-stopping structure 32. In the embodiment, the fastening portion 311 is located at one end of the wire groove 312, the fastening portion 311 has a fastening groove 3111, and the first combination portion 321 of the wire-stopping structure 32 engages with the fastening groove 3111. Here, the wire-stopping structure 32 is like an upside-down U shape. When assembling, the opening of the upside-down U shape corresponds to the fastening portion 311 and the wire-stopping structure 32 is disposed in the wire groove 312. Then the first combination portion 321 exposed from the wire groove 312 is pushed to the fastening groove 3111 and the assembly is thus completed.

In the embodiment, the positioning portion 313 is located in the wire groove 312 near the central section to interfere with the wire-stopping structure 32 so the wire-stopping structure 32 is located within the wire groove 312 and not exposed from the outer wall 314. As a result, the wire in the wire groove 312 would not protrude from the outer wall 314, so it would not interfere with external elements or wear. Thus, it is easier to install the fan module.

Figure 7A:
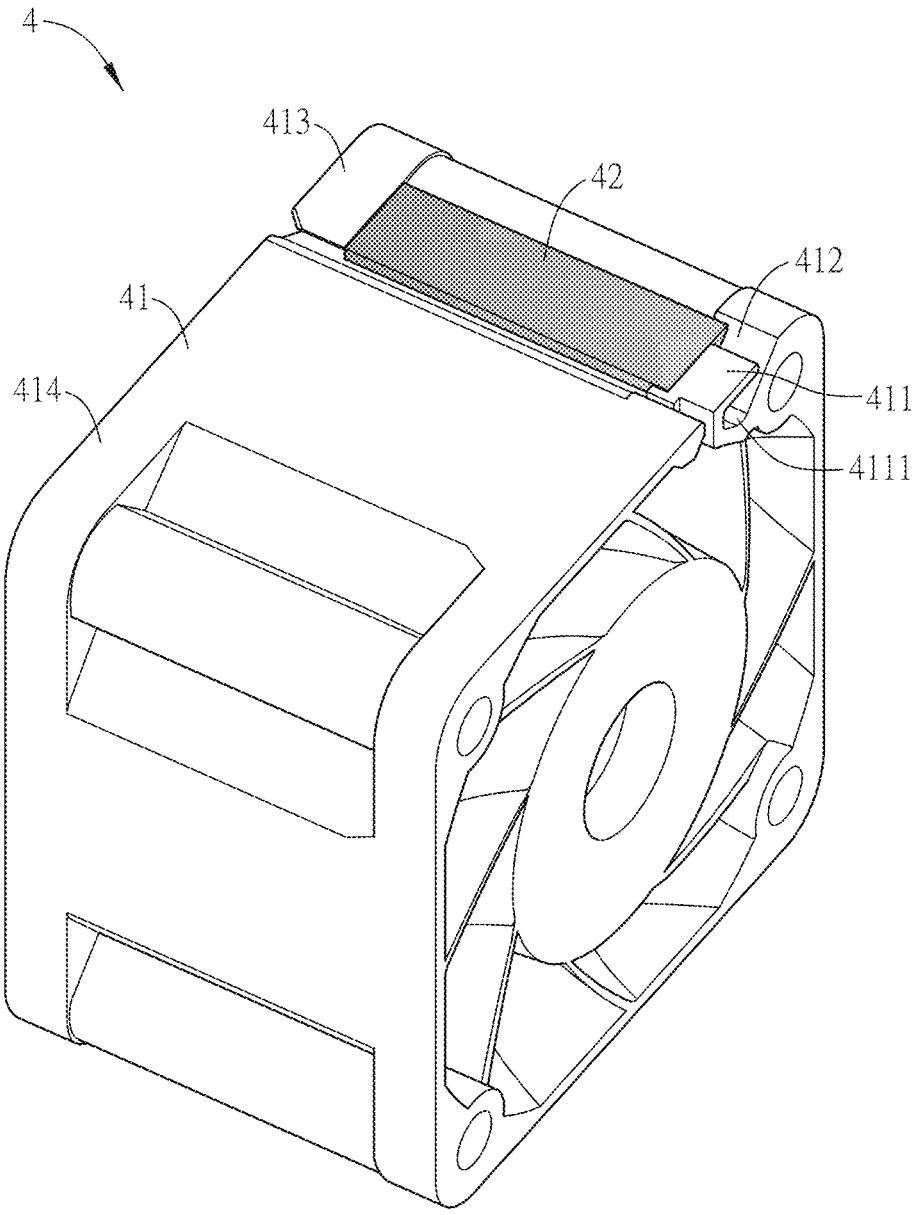
FIG. 7A is a perspective schematic diagram showing a fan frame module according to the seventh embodiment of the invention.
Figure 7B:
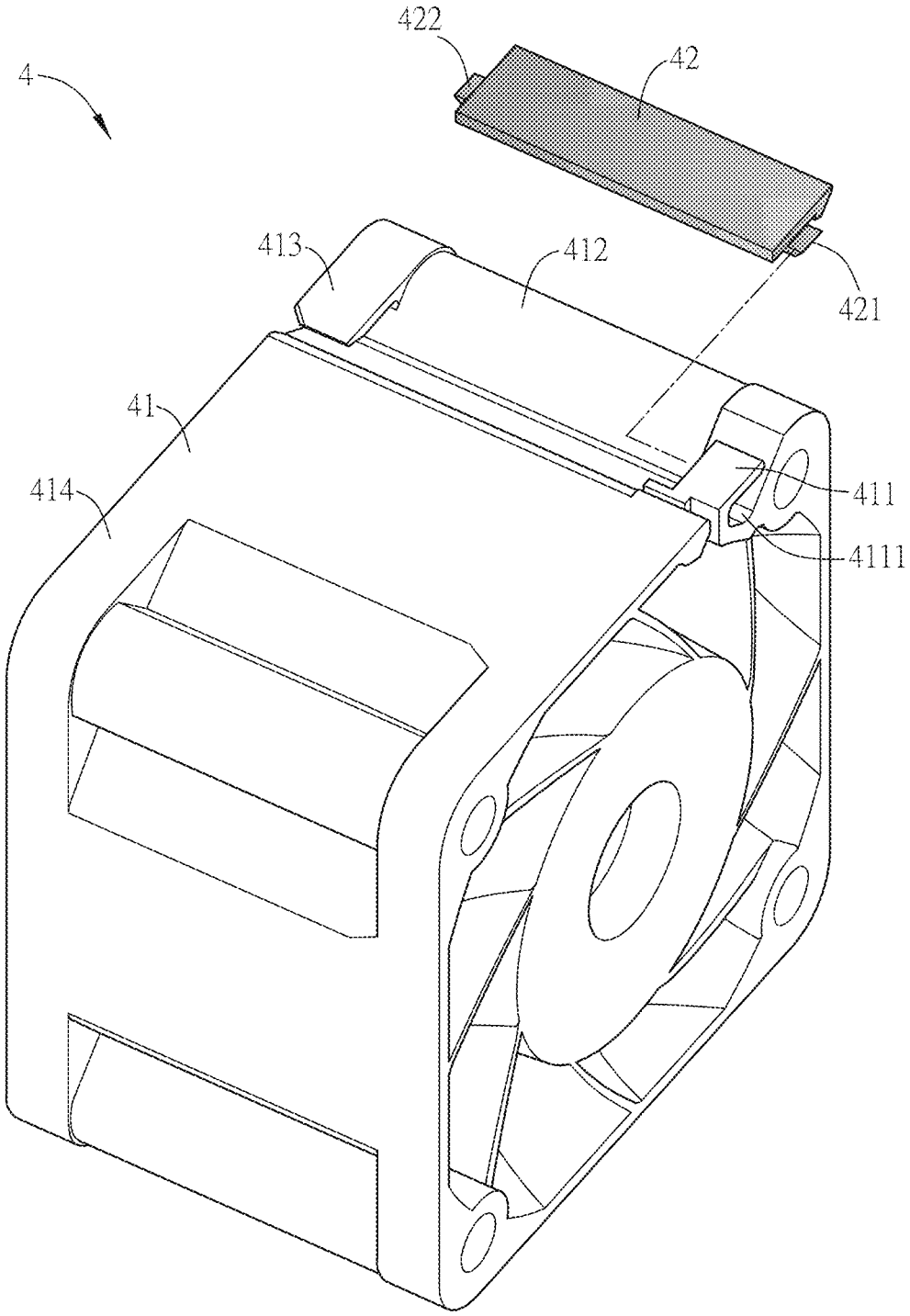
FIG. 7B is an exploded view of the fan frame module in FIG. 7A.

FIG. 7A is a perspective schematic diagram showing a fan frame module according to the seventh embodiment of the invention, and FIG. 7B is an exploded view of the fan frame module in FIG. 7A. Referring to FIG. 7A and FIG. 7B, the fan frame module 4 includes the frame 41 and the wire-stopping structure 42. In the embodiment, the fastening portion 411 of the frame 41 is located at one end of the wire groove 412, and the positioning portion 413 is located at the other end of the wire groove 412. The fastening portion 411 has a fastening groove 4111. The first combination portion 421 of the wire-stopping structure 42 engages with the fastening groove 4111. The second combination portion 422 of the wire-stopping structure 42 abuts the positioning portion 413. The wire-stopping structure 42 is disposed at the fastening groove 4111 and the positioning portion 413 by the first combination portion 421 and the second combination portion 422 so the wire-stopping structure 42 is located within the wire groove 412 and not exposed from the outer wall 414. The wire in the wire groove 412 would not protrude from the outer wall 414, so it would not interfere with external elements or wear. Thus, it is easier to install the fan module.

Figure 7C:
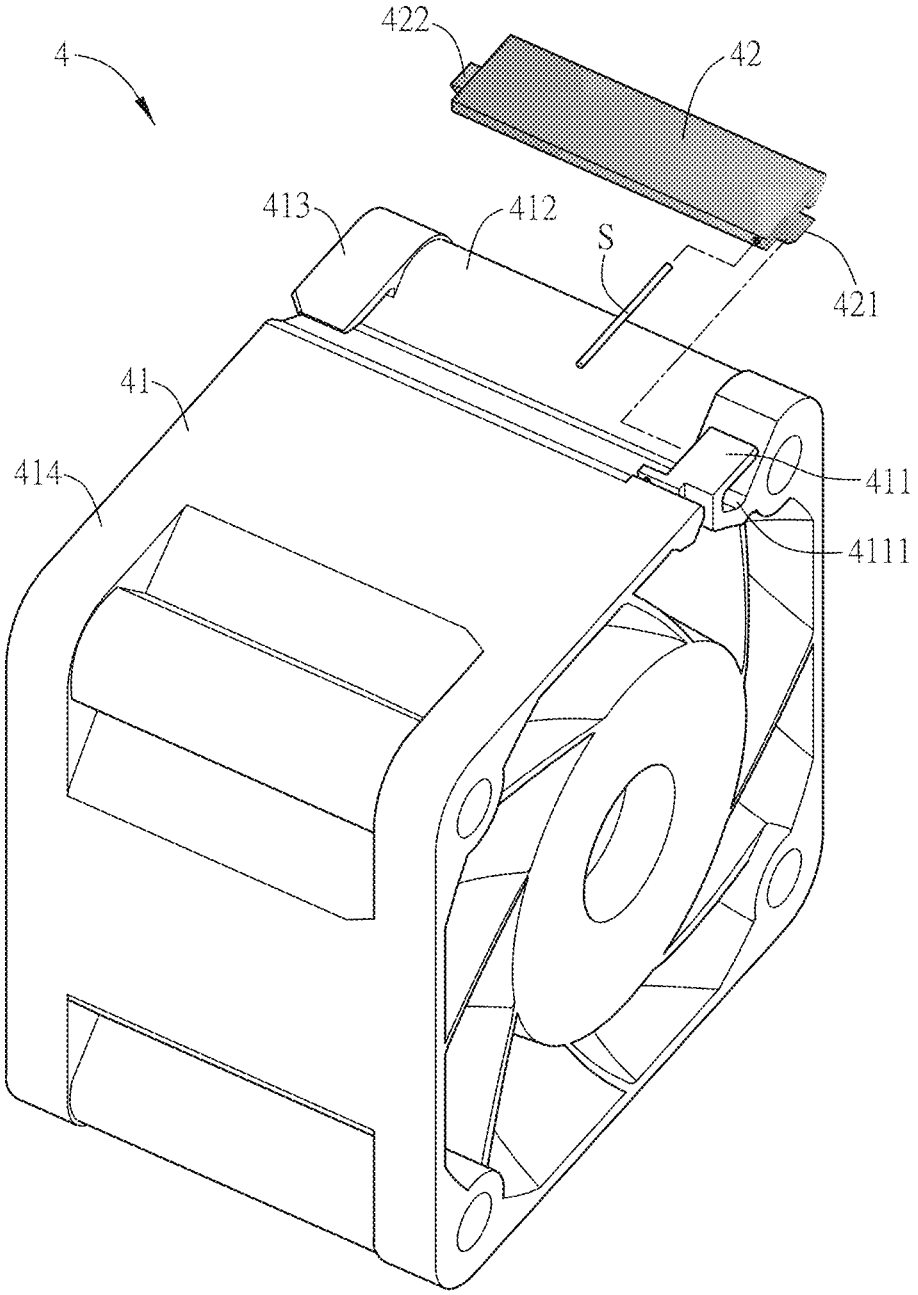
FIG. 7C is an exploded view of another aspect of the fan frame module in FIG. 7A.

Besides, referring to FIG. 7C, FIG. 7C is an exploded view of another aspect of the fan frame module in FIG. 7A. In this aspect, in addition to the previous connection manner, the wire-stopping structure 42 may pivot on the pivot S at the fastening portion. As a result, the wire-stopping structure 42 is further firmly disposed on the frame 41 to prevent the wire-stopping structure 42 and the frame 41 from being separated.

Figure 8A:
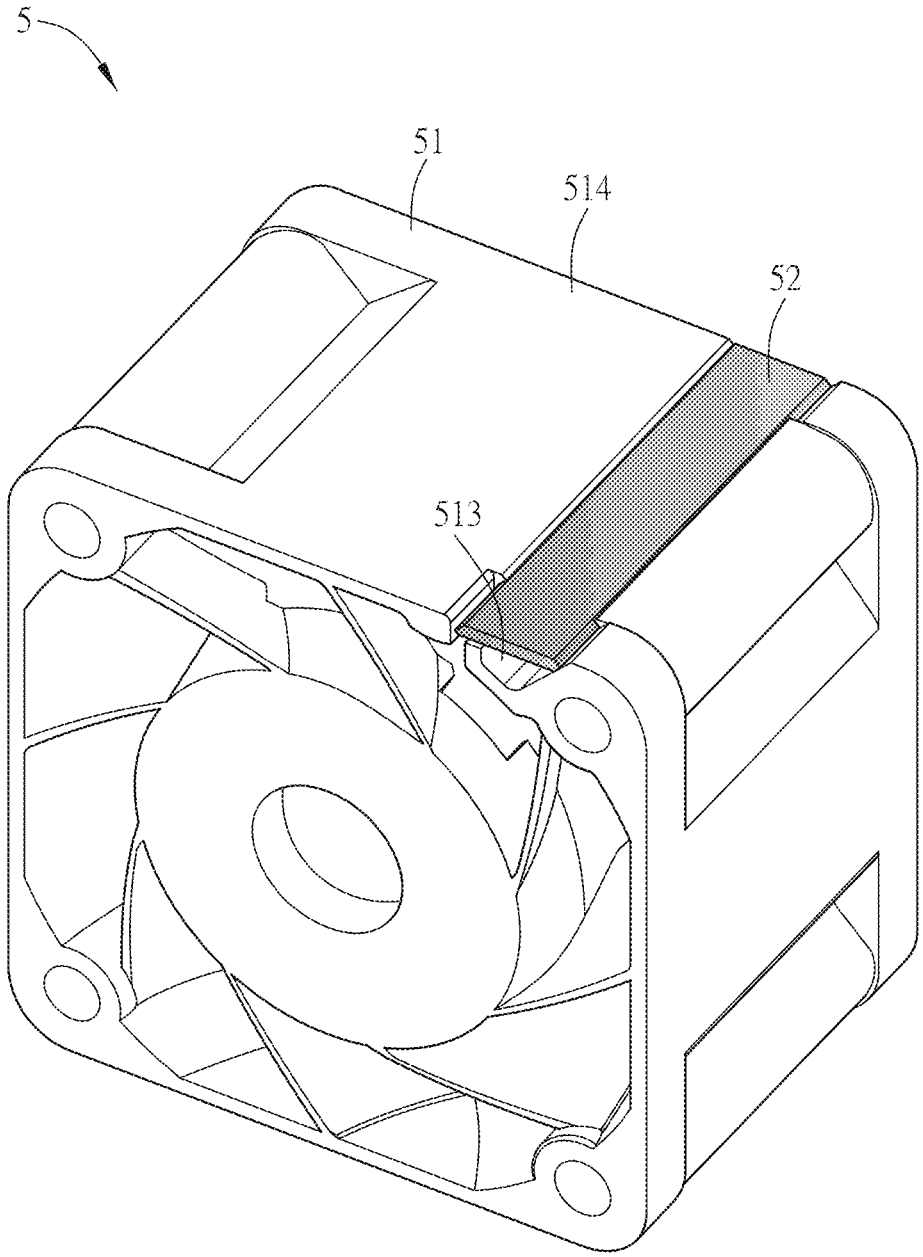
FIG. 8A is a perspective schematic diagram showing a fan frame module according to the eighth embodiment of the invention.
Figure 8B:
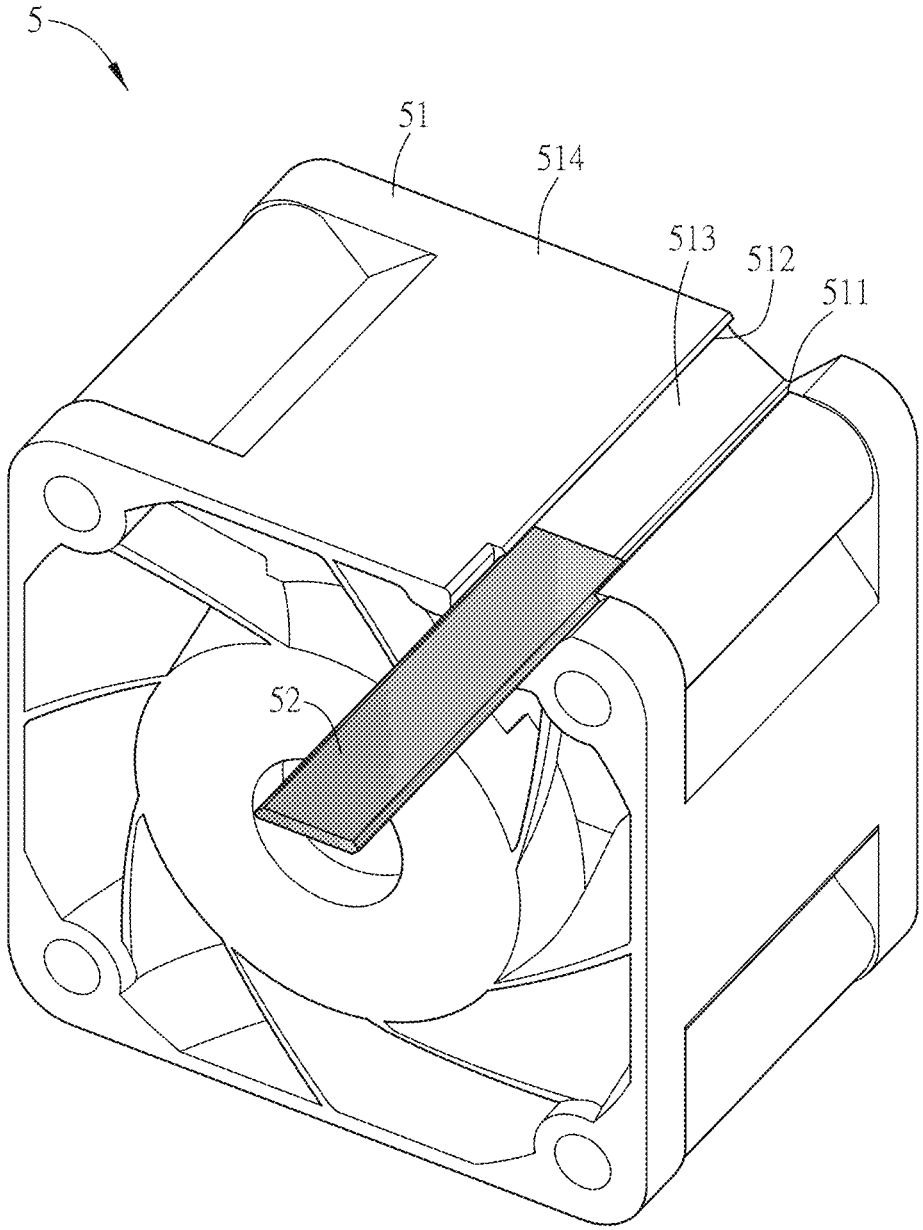
FIG. 8B is an exploded view of the fan frame module in FIG. 8A.
Figure 8C:
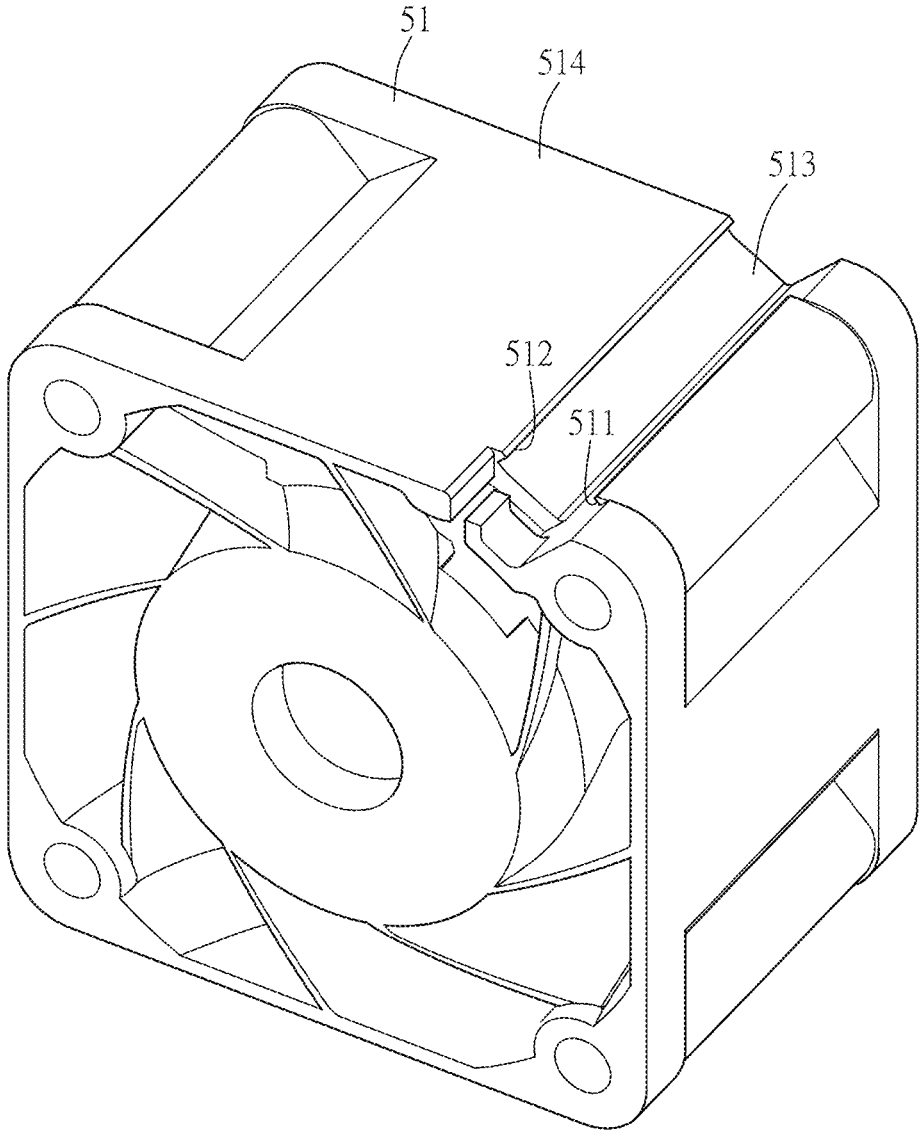
FIG. 8C is a schematic diagram showing the frame of the fan frame module in FIG. 8A.
Figure 9:
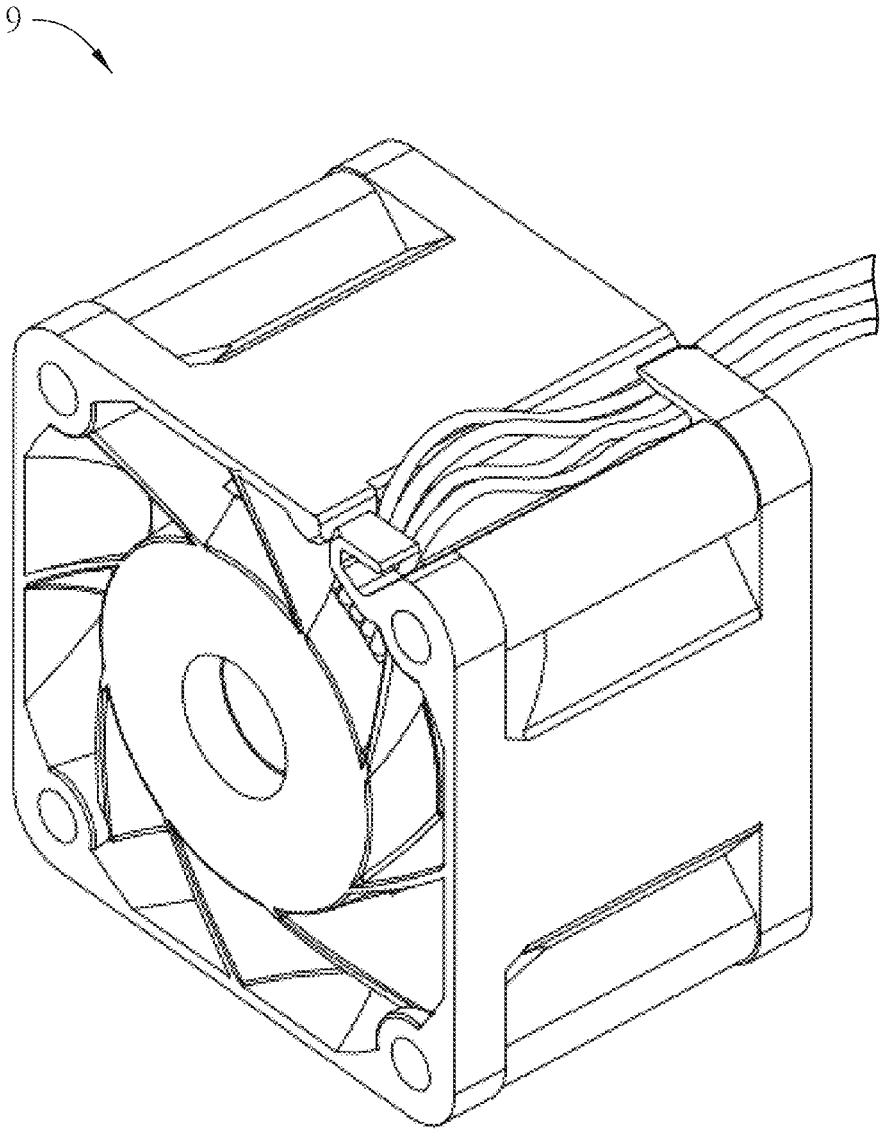
FIG. 9 is a schematic diagram showing the fan module according to conventional technique.

FIG. 8A is a perspective schematic diagram showing a fan frame module according to the eighth embodiment of the invention, FIG. 8B is an exploded view of the fan frame module in FIG. 8A, and FIG. 8C is a schematic diagram showing the frame of the fan frame module in FIG. 8A. Referring to FIG. 8A, FIG. 8B and FIG. 8C, the fan frame module 5 includes the frame 51 and the wire-stopping structure 52. In the embodiment, the fastening portion 511 and the positioning portion 512 of the frame 51 are chutes and the wire-stopping structure 52 slides in these chutes (the fastening portion 511 and the positioning portion 512), so the wire-stopping structure 52 is held and fixed to the outer wall and not exposed from the outer wall 514. Thus, the wire in the wire groove 513 would not protrude from the outer wall 514, so it would not interfere with external elements or wear. Thus, it is easier to install the fan module.

A fan module including a frame, a wire-stopping structure and an impeller is also disclosed. The frame includes an outer wall, a wire groove, at least one fastening portion and at least one positioning portion. The outer wall is sequentially divided into a first side section, a first mid section, a central section, a second mid section and a second side section in a first direction. The extension direction of the major axis of the central section is parallel to the central axis of the frame, and the first direction is perpendicular to extension direction of the major axis of the central section.

The wire groove is formed on the first mid section to accommodate at least one wire. The fastening portion is disposed on one side of the wire groove in the first direction. The positioning portion is disposed on the other side of the wire groove in the first direction. The wire-stopping structure is held by the fastening portion and the positioning portion and fixed to the outer wall. The impeller is disposed in the frame. Because technique features and the mutual relationships of the frame and the wire-stopping structure have been descripted in the previous embodiments, they are not repeated here.

It is noted that in all embodiments, the variation of each element, component or unit could be mutually applied to any embodiments, and they are not only limited to the embodiments mentioned above.

In summary, as to the fan frame module and the fan module, because the wire-stopping structure covers the wire groove of the frame, the wire in the wire groove would not protrude from the outer wall. Thus, the wire would not interfere with external elements or wear, and it is easier to install the fan module. In some embodiments, the wire-stopping structure may further cover and shield the outlet hole of the frame so as to avoid the air leak occurring in the outlet hole of the conventional fan and improve characteristics of the air pressure and air volume.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan frame module, comprising:

a frame, comprising:

an outer wall;

a wire groove, formed on the outer wall to accommodate at least one wire;

a wire-guiding structure which leads the wire into the wire groove or leads the wire out of the wire groove, wherein the wire-guiding structure forms a holding space communicating with the wire groove, so that the wire is held and fixed in the holding space;

at least one protruding block, disposed on one side of the wire groove as a convex structure; and at least two protruding portions, disposed on the other side of the wire groove as convex structures; and a wire-stopping board, held by the protruding block and the protruding portions, and fixed to the outer wall, wherein the protruding block and the protruding portions are interlaced disposed; and the wire-stopping board comprising:

a first indentation, engaged with the protruding block; and at least two second indentations, engaged with the at least two protruding portions, respectively, wherein the protruding block and one of the protruding portions are respectively located at different lateral surfaces of the wire groove, and are respectively extend from the outer wall to each other;

wherein the first indentation correspondingly abuts the protruding block, the wire-stopping board is pushed in underneath the protruding portions, so that the wire-stopping board is fixed by the protruding block and the protruding portions and covers the wire groove.

2. The fan frame module of claim 1, wherein the wire groove has two of the lateral surfaces and the two of the lateral surfaces are disposed oppositely.

3. The fan frame module of claim 2, wherein the wire-guiding structure is disposed at one end of the wire groove.

4. The fan frame module of claim 3, wherein the wire-guiding structure is a structure from the bottom of the wire groove along the lateral surfaces to the top opening of the wire groove, and is bent to extend in parallel with the outer wall.

5. The fan frame module of claim 3, wherein an acute included angle is formed between the protruding block and one of the lateral surfaces.

6. The fan frame module of claim 3, wherein an acute included angle is formed between any one of the at least two protruding portions and a corresponding one of the lateral surfaces.

7. A fan frame module, comprising:

a frame, comprising:

an outer wall;

a wire groove, formed on the outer wall to accommodate at least one wire;

a wire-guiding structure which leads the wire into the wire groove or leads the wire out of the wire groove, wherein the wire-guiding structure forms a holding space communicating with the wire groove, so that the wire is held and fixed in the holding space;

a protruding block, disposed on one side of the wire groove and having a fastening groove; and a protruding portion, disposed in the wire groove; and a wire-stopping board, having a protruding part engaged with the fastening groove, wherein the protruding portion is interfered with the wire-stopping structure;

wherein the protruding block and the protruding portion are respectively extend from the outer wall;

wherein the protruding part correspondingly abuts the protruding block, the wire-stopping board is pushed in underneath the protruding portions, so that the wire-stopping board is fixed by the protruding block and the protruding portions and covers the wire groove.

8. The fan frame module of claim 7, wherein the wire groove has two lateral surfaces disposed oppositely.

9. The fan frame module of claim 8, wherein the protruding block is a structure from the bottom of the wire groove along the lateral surface to the top opening of the wire groove, and is bent to extend in parallel with the outer wall.

10. A fan frame module, comprising:

a frame, comprising:

an outer wall;

a wire groove, formed on the outer wall to accommodate at least one wire;

a wire-guiding structure which leads the wire into the wire groove or leads the wire out of the wire groove, wherein the wire-guiding structure forms a holding space communicating with the wire groove, so that the wire is held and fixed in the holding space;

a protruding block, located at one end of the wire groove and having a fastening groove; and a protruding portion, located at the other end of the wire groove; and a wire-stopping structure, having a first protruding part engaged with the fastening groove, and a second protruding part abutted the protruding portion, wherein the protruding block and the protruding portion are respectively located at different lateral surfaces of the wire groove, and are respectively extend from the outer wall to each other;

wherein the first protruding part correspondingly abuts the protruding block, the wire-stopping board is pushed in underneath the protruding portions, so that the wire-stopping board is fixed by the protruding block and the protruding portions and covers the wire groove.

* * * * *